US011254122B1

(12) United States Patent
Manabe et al.

(10) Patent No.: US 11,254,122 B1
(45) Date of Patent: Feb. 22, 2022

(54) IMAGE FORMING APPARATUS

(71) Applicant: FUJIFILM Business Innovation Corp., Tokyo (JP)

(72) Inventors: Chikara Manabe, Ebina (JP); Masato Matsuzuki, Ebina (JP); Yoshiyuki Taguchi, Ebina (JP); Kunio Miyakoshi, Ebina (JP); Maki Hasegawa, Ebina (JP); Masashi Hiratsuka, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/130,171

(22) Filed: Dec. 22, 2020

(30) Foreign Application Priority Data

Aug. 20, 2020 (JP) ..... JP2020-139453

(51) Int. Cl.
*B41J 2/045* (2006.01)
*B41J 2/21* (2006.01)

(52) U.S. Cl.
CPC ..... *B41J 2/04505* (2013.01); *B41J 2/04573* (2013.01); *B41J 2/2135* (2013.01)

(58) Field of Classification Search
CPC .. B41J 2/04505; B41J 2/04556; B41J 15/046; B41J 19/145; B41J 2/04508; B41J 2/04573; B41J 29/393; B41J 2/12; B41J 2/2135; B41J 2/512; B41J 13/26; B41J 15/24; B41J 19/147; B41J 2002/17569; B41J 2029/3935; B41J 2/04558; B41J 11/42
See application file for complete search history.

(56) References Cited

U.S. PATENT DOCUMENTS

2006/0269342 A1* 11/2006 Yoshida ..... H04N 1/128 400/62
2013/0044347 A1* 2/2013 Kitai ..... H04N 1/3878 358/1.14

(Continued)

FOREIGN PATENT DOCUMENTS

| | | |
|---|---|---|
| JP | 2005-035083 | 2/2005 |
| JP | 2007-322722 | 12/2007 |
| JP | 2014-010422 | 1/2014 |

OTHER PUBLICATIONS

English language machine translation of JP 2005-035083.
English language machine translation of JP 2007-322722.
English language machine translation of JP 2014-010422.

*Primary Examiner* — Kristal Feggins
(74) *Attorney, Agent, or Firm* — Fildes & Outland, P.C.

(57) ABSTRACT

An image forming apparatus includes: an extraction unit configured to extract an image for position detection from job image data; a first image forming unit configured to form the image for position detection on a recording medium; a second image forming unit disposed on a downstream in a feeding direction of the recording medium relative to the first image forming unit; a first detection unit configured to detect the image for position detection formed by the first image forming unit; and a determining unit configured to determine a correction amount of an image forming position of the second image forming unit based on a position of the image for position detection that is detected by the detection unit and a position of the image for position detection in the image data.

20 Claims, 16 Drawing Sheets

(56) References Cited

U.S. PATENT DOCUMENTS

2014/0301748 A1* 10/2014 Suzuki ..... G03G 15/5058
399/49
2017/0134512 A1* 5/2017 Wyatt ..... H04L 67/22

* cited by examiner

IMAGE FORMING APPARATUS

CROSS-REFERENCE TO RELATED APPLICATIONS

This application is based on and claims priority under 35 USC 119 from Japanese Patent Application No. 2020-139453 filed on Aug. 20, 2020.

BACKGROUND

Technical Field

The present invention relates to an image forming apparatus.

Related Art

Patent Literature 1 discloses a recording apparatus including: a plurality of recording heads that are disposed in parallel in a recording medium width in a direction perpendicular to a feeding direction in which a recording medium is conveyed, and records an image of the recording medium width; a pattern recording unit that repeatedly records a predetermined pattern; a reading unit that is disposed on an upstream in a feeding direction of the recording medium of each recording head among the recording heads, and reads the predetermined pattern recorded by the pattern recording unit; an adjustment unit that adjusts a recording position of the recording head in a direction perpendicular to the feeding direction among the recording heads; and a control unit that controls the adjustment unit to adjust the recording position by the adjustment unit based on a reading result of the reading unit.

Patent Literature 2 discloses an image forming apparatus including: a plurality of image forming units that are provided for each color and form color images on a recording medium by performing a main scanning and a sub scanning, a control unit that controls the plurality of image forming units to form an image based on image data, and controls the plurality of image forming units to form a resist mark including a first resist mark in which a shift in a main scanning direction does not appear in a sub scanning direction and a second resist mark in which the shift in the main scanning direction appears in the sub scanning direction, each of the first resist mark and the second resist mark including a mark of a reference color and a mark of another color different from the reference color, which is apart from the mark of the reference color with a predetermined interval in the sub scanning direction; a reading unit that reads the first resist mark and the second resist mark formed on the recording medium; a first calculation unit that calculates a correction amount in the sub scanning direction based on a reading result of the reading unit by using a shift amount of the mark of another color in the sub scanning direction, based on the mark of the reference color, for the first resist mark; a second calculation unit that calculates a correction amount in the main scanning direction based on a reading result of the reading unit by using a shift amount of the mark of another color in the sub scanning direction, based on the mark of the reference color, for the first resist mark and a shift amount of the mark of another color in the sub scanning direction, based on the mark of the reference color, for the second resist mark; and an image forming position correction unit that corrects, based on the correction amounts calculated by the first calculation unit and the second calculation unit, an image forming position based on the image data.

Patent Literature 3 discloses an image forming apparatus including: a reception unit that receives print jobs; an image forming unit that records an image on paper; an extraction unit that extracts a partial image, which may be substituted as patches used for density detection, from normal images of the print jobs formed by the image forming unit; and an image reading unit that reads image density information of the partial image extracted and fixed on the paper, in which image quality adjustment is performed based on the image density information of the read partial image.

CITATION LIST

Patent Literature

Patent Literature 1: JP-A-2005-35083
Patent Literature 2: JP-A-2007-322722
Patent Literature 3: JP-A-2014-10422

SUMMARY

In a configuration in which a mark dedicated to detection is formed on a recording medium, and the mark is detected to adjust color registration, a region where the mark is formed is required to be provided on the recording medium, so that an image region of the recording medium, which may be used by a user, is narrowed.

Aspects of non-limiting embodiments of the present disclosure relate to increase an image region of a recording medium, which may be used by a user, as compared with a configuration in which a mark dedicated to detection is formed on a recording medium.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: an extraction unit configured to extract an image for position detection from job image data; a first image forming unit configured to form the image for position detection on a recording medium; a second image forming unit disposed on a downstream in a feeding direction of the recording medium relative to the first image forming unit; a first detection unit configured to detect the image for position detection formed by the first image forming unit; and a determining unit configured to determine a correction amount of an image forming position of the second image forming unit based on a position of the image for position detection that is detected by the detection unit and a position of the image for position detection in the image data.

BRIEF DESCRIPTION OF DRAWINGS

Exemplary embodiment(s) of the present invention will be described in detail based on the following figures, wherein.

DETAILED DESCRIPTION

Hereinafter, an example of exemplary embodiments according to the present invention will be described with reference to the drawings.

(Inkjet Recording Apparatus 10)

Figure 1:
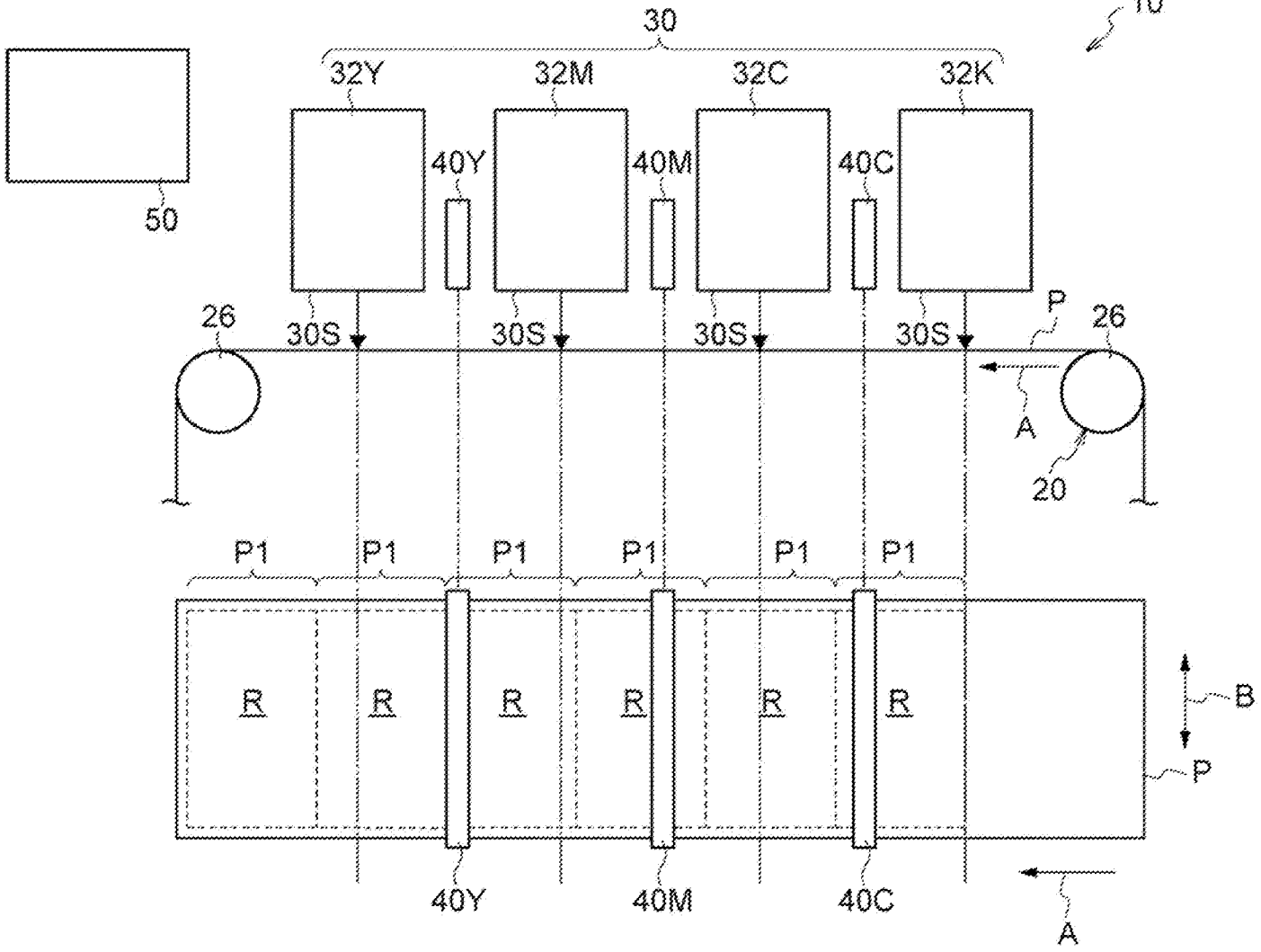
FIG. 1 is a schematic diagram showing a configuration of an inkjet recording apparatus according to a first exemplary embodiment.

First, the inkjet recording apparatus 10 will be described. FIG. 1 is a schematic view showing a configuration of the inkjet recording apparatus 10. FIG. 1 shows a side view of the inkjet recording apparatus 10 on an upper part of a paper surface, and shows a plan view of a continuous paper P described below and detection units 40C, 40M, 40Y as viewed from above on a lower pan of the paper surface.

The inkjet recording apparatus 10 shown in FIG. 1 is an example of an image forming apparatus that forms an image on a recording medium. As shown in FIG. 1, the inkjet recording apparatus 10 is specifically an apparatus that ejects ink droplets to a continuous paper P (an example of the recording medium) to form an image on the continuous paper P. Therefore, the inkjet recording apparatus 10 is also referred to as an ejection apparatus that ejects droplets.

As shown in FIG. 1, the continuous paper P is an elongated recording medium having a length in a feeding direction of the continuous paper to be conveyed. Specifically, the continuous paper P is a paper in which a plurality of pages PI are arranged along the feeding direction.

As shown in FIG. 1, the inkjet recording apparatus 10 includes a conveyance mechanism 20, an image forming unit 30, detection units 40C, 40M, 40Y, and a control device 50. Specific configurations of each part (the conveyance mechanism 20, the image forming unit 30, the detection units 40C, 40M, 40Y, and the control device 50) of the inkjet recording apparatus 10 will be described below.

(Conveyance Mechanism 20)

The conveyance mechanism 20 shown in FIG. 1 is a mechanism that conveys the continuous paper P. Specifically, as shown in FIG. 1, the conveyance mechanism 20 includes, for example, a plurality of wrap rollers 26, an unwinding roller (not shown), and a winding roller (not shown).

In the conveyance mechanism 20, the rotationally driven winding roller (not shown) winds up the continuous paper P, and the unwinding roller (not shown) unwinds the continuous paper P, and thereby, the continuous paper P is conveyed at a predetermined conveyance speed. The plurality of wrap rollers 26 are a roller around which the continuous paper P is wrapped. The continuous paper P is wrapped around the plurality of wrap rollers 26 between the unwinding roller (not shown) and the winding roller (not shown). Accordingly, a feeding path of the continuous paper P from the unwinding roller (not shown) to the winding roller (not shown) is determined. In the drawings, the feeding direction of the continuous paper P (hereinafter, may be simply referred to as a "feeding direction") is indicated by an arrow A as appropriate.

The configuration of the conveyance mechanism 20 is not limited to the above configuration. For example, the conveyance mechanism 20 may be a mechanism that conveys the continuous paper P from an accommodating unit in which the continuous paper P is accommodated in a folded state to an accommodating unit in which the continuous paper P is to be accommodated so as to be folded. The conveyance mechanism 20 may be a mechanism in which a pair of conveyance rollers, a conveyance belt, or the like may be used as a conveyance member that conveys the continuous paper P.

Further, the continuous paper P is used as a recording medium in the present exemplary embodiment, but the present invention is not limited to this example. For example, a sheet (that is, a cut sheet) may be used as the recording medium.

(Image Forming Unit 30)

The image forming unit 30 shown in FIG. 1 has a function of forming an image on the continuous paper P. Specifically, the image forming unit 30 ejects, in a non-contact manner, ink droplets onto the continuous paper P conveyed by the conveyance mechanism 20 to form an image. More specifically, as shown in FIG. 1, the image forming unit 30 includes ejection heads 32K, 32C, 32M, 32Y (hereinafter, referred to as 32K to 32Y).

Each of the ejection heads 32K to 32Y is a head that ejects ink droplets. Specifically, each of the ejection heads 32K to 32Y ejects ink droplets of respective colors of black (K), cyan (C), magenta (M), and yellow (Y) onto the continuous paper P to form an image on the continuous paper P. More specifically, each of the ejection heads 32K to 32Y is configured as follows.

As shown in FIG. 1, the ejection heads 32K to 32Y are disposed in this order toward a downstream in the paper feeding direction. Each of the ejection heads 32K to 32Y has a length in a width direction of the continuous paper P. The width direction of the continuous paper P refers to a direction that intersects the feeding direction (specifically, a direction which is perpendicular to the feeding direction). In the drawings, the width direction of the continuous paper P (hereinafter, may be referred to as a "paper width direction") is indicated by an arrow B as appropriate.

Each of the ejection heads 32K to 32Y has a nozzle surface 30S on which a nozzle (not shown) is formed. The nozzle surface 30S of each of the ejection heads 32K to 32Y faces downward and faces the continuous paper P conveyed by the conveyance mechanism 20 with a gap therebetween. Each of the ejection heads 32K to 32Y elects ink droplets from the nozzle (not shown) onto the continuous paper P by a known method such as a thermal method and a piezoelectric method to form an image based on image data.

Examples of ink used in each of the ejection heads 32K to 32Y include aqueous ink and oily ink. The aqueous ink contains, for example, a solvent containing water as a main component, and a colorant (specifically, a pigment or a dye), and other additives. The oily ink includes, for example, an organic solvent, a colorant (specifically, a pigment or a dye), and other additives.

Specifically, each of the ejection heads 32K to 32Y in the image forming unit 30 ejects ink droplets of respective colors onto the continuous paper P to form an image on the continuous paper P, so that the image forming unit 30 is also an example of an ejection mechanism that ejects liquid droplets.

Hereinafter, a black (K) image formed by the ejection head 32K is referred to as K image, and a cyan (C) image formed by the ejection head 32C is referred to as C image. In addition, a magenta (M) image formed by the ejection head 32M is referred to as M image, and a yellow (Y) image formed by the ejection head 32Y is referred to as Y image.

In the present exemplary embodiment, each of the ejection heads 32K. 32C, 32M is an example of each of first to third forming units. Any one of each of the ejection heads 32K, 32C, 32Y, each of the ejection heads 32K, 32M, 32Y, and each of the ejection heads 32C, 32M, 32Y may be considered as an example of each of the first to third forming units.

The ejection head 32K may be considered as an example of the first forming unit, and any one or two of the ejection heads 32C, 32M, 32Y may be considered as an example of the second forming unit. The ejection head 32C may be considered as an example of the first forming unit, and any one or two of the ejection heads 32M, 32Y may be considered as an example of the second forming unit. The ejection head 32M may be considered as an example of the first forming unit, and the ejection head 32Y may be considered as an example of the second forming unit.

(Detection Unit 40C, 40M, 40Y)

The detection units 40C, 40M, 40Y (hereinafter, referred to as 40C to 40Y) shown in FIG. 1 detect an image formed on the continuous paper P. The detection units 40C to 40Y are configured with a reflective optical sensor as an example.

As shown in FIG. 1, the detection units 40C to 40Y each have a length that is equal to or larger than a width of an image region R of the continuous paper P. In other words, detection ranges of the detection units 40C to 40Y each have a length that is equal to or larger than the width of the image region R of the continuous paper P. Specifically, the detection units 40C to 40Y each have a length that is equal to or larger than the width of the continuous paper P. That is, the detection ranges of the detection units 40C to 40Y each have a length that is equal to or larger than the width of the continuous paper P. The width of the continuous paper P refers to a length along the paper width direction.

In the present exemplary embodiment, the detection units 40C to 40Y are disposed between the ejection heads 32K to 32Y. Specifically, the detection unit 40C is disposed between the ejection head 32K and the ejection head 32C in the feeding direction. That is, the detection unit 40C is disposed on a downstream in the feeding direction relative to the ejection head 32K and on an upstream in the feeding direction relative to the ejection head 32C. It should be noted that the detection unit 40C may be disposed at a position with an equal distance to the ejection head 32K and the ejection head 32C, or at a position near one of the ejection head 32K and the ejection head 32C.

The detection unit 40M is disposed between the ejection head 32C and the ejection head 32M in the feeding direction. That is, the detection unit 40M is disposed on a downstream in the feeding direction relative to the ejection head 32C and on an upstream in the feeding direction relative to the ejection head 32M. It should be noted that the detection unit 40M may be disposed at a position with an equal distance to the ejection head 32C and the ejection head 32M, or at a position near one of the ejection head 32C and the ejection head 32M.

The detection unit 40Y is disposed between the ejection head 32M and the ejection head 32Y in the feeding direction. That is, the detection unit 40Y is disposed on a downstream in the feeding direction relative to the ejection head 32M and on an upstream in the feeding direction relative to the ejection head 32Y. It should be noted that the detection unit 40Y may be disposed at a position with an equal distance to the ejection head 32M and the ejection head 32Y, or at a position near one of the ejection head 32M and the ejection head 32Y.

The detection units 40C, 40M, 40Y are an example of a detection unit. Specifically, when the ejection head 32C is considered as an example of the second forming unit, the detection unit 40C is considered as an example of a detection unit or a first detection unit. When the ejection head 32M is considered as an example of the second forming unit, the detection unit 40M is considered as an example of a detection unit or a first detection unit. When the ejection head 32Y is considered as an example of the second forming unit, the detection unit 40Y is considered as an example of a detection unit.

When the ejection head 32M is considered as an example of the third forming unit, the detection unit 40M is considered as an example of a detection unit or a second detection unit. When the ejection head 32Y is considered as an example of the third forming unit, the detection unit 40Y is considered as an example of a second detection unit.

(Control Device 50)

Figure 2:
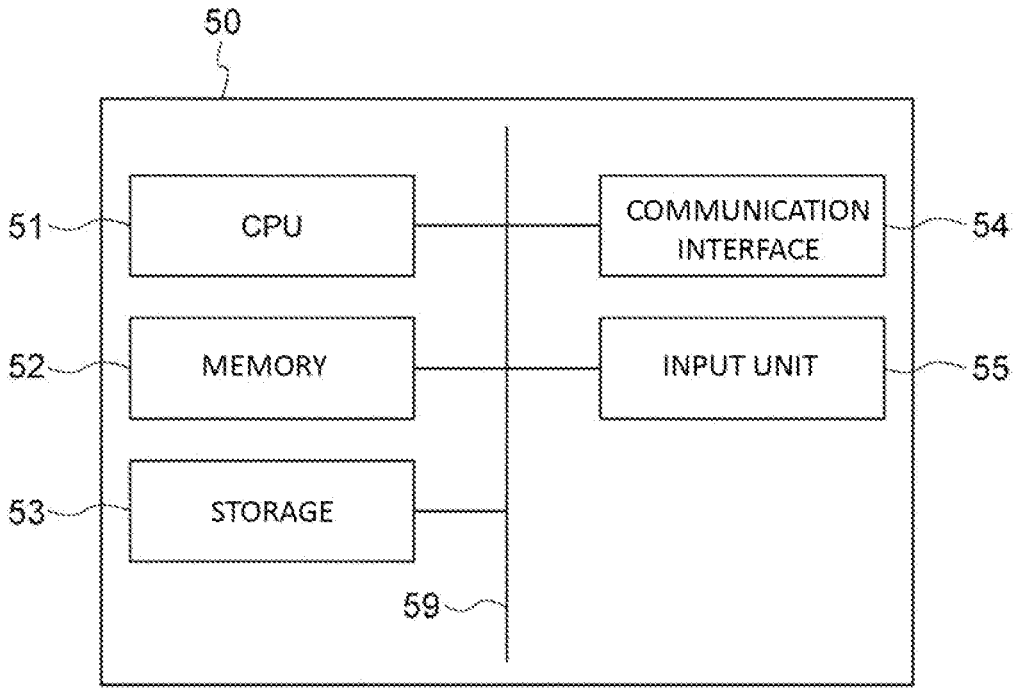
FIG. 2 is a block diagram showing a hardware configuration of a control device according to the first exemplary embodiment.

FIG. 2 is a block diagram showing a hardware configuration of the control device 50 according to the present exemplary embodiment. The control device 50 shown in FIG. 2 is a device that controls operation of each unit (for example, the conveyance mechanism 20 and the image forming unit 30) of the inkjet recording apparatus 10. Specifically, the control device 50 includes a central processing unit (CPU) 51, a memory 52, a storage 53, a communication interface 54, and an input unit 55 as shown in FIG. 2. The units of the control device 50 are communicably connected to each other via a bus 59.

The storage 53 stores various programs including a control program and various pieces of data including control data. The control program is a program that causes a computer including a CPU 51 to function as the control device 50. Specifically, the storage 53 is implemented by a recording device such as a hard disk drive (HDD), a solid state drive (SSD), and a flash memory.

The memory 52 is a work area for the CPU 51 to execute various programs, and temporarily stores various programs or various pieces of data when the CPU 51 executes processing. The CPU 51 reads various programs including the control program from the storage 53 into the memory 52, and executes a program using the memory 52 as a work area.

The communication interface 54 is an interface for communicating with an external device. The communication interface 54 transmits and receives various pieces of data to and from the external device through communication using various wired or wireless communication lines.

The input unit 55 is a functional unit for a user to perform various input operations. Specifically, the input unit 55 includes a mechanical operation key, such as a keyboard, and a touch panel.

Figure 3:
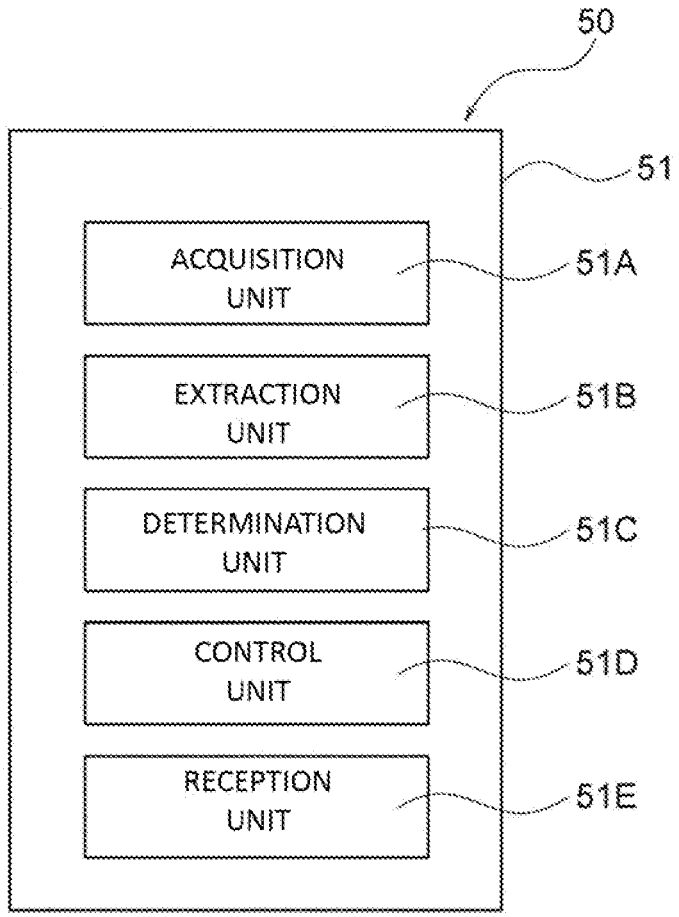
FIG. 3 is a block diagram showing a functional configuration of a CPU according to the first exemplary embodiment.

In the control device 50, CPU 51 implements various functions of controlling the inkjet recording apparatus 10 by executing the control program. Hereinafter, a functional configuration implemented by cooperation of the CPU 51 serving as a hardware resource and a control program serving as a software resource will be described. FIG. 3 is a block diagram showing a functional configuration of the CPU 51.

As shown in FIG. 3, in the control device 50, the CPU 51 executes the control program to function as an acquisition unit 51A, an extraction unit 51B, a determining unit 51C, a control unit 51D, and a reception unit 51E. The extraction unit 51B is an example of an extraction unit, the determining unit 51C is an example of a determining unit, and the reception unit 51E is an example of a reception unit.

(Acquisition Unit 51A)

The acquisition unit 51A acquires a job execution instruction to execute a job related to image formation and job information related to the job.

Specifically, the acquisition unit 51A receives the job execution instruction and the job information from the external device through, for example, the communication interface 54 to acquire the job execution instruction and the job information.

The term job refers to a processing unit of image forming operation to be executed according to an execution instruction of one image formation. The job information includes at least information on whether a mark for processing (hereinafter, referred to as a "processing mark") is attached, and image data.

The processing mark is a mark used for processing of the continuous paper P and is a predetermined mark. Specifically, the processing mark is a mark having a predetermined shape and size. In the present exemplary embodiment, the processing mark is a mark (a so-called register mark) indicating a cutting position of the continuous paper P. As an example in the present exemplary embodiment, a line having a predetermined thickness and length, which extends along the feeding direction intersects a line having a predetermined thickness and length, which extends along the paper width direction, to form the processing mark. In addition, the processing mark is a mark formed by the K image that is formed by the ejection head 32K disposed on the most upstream.

As an example, the cutting of the continuous paper P is executed as a post-step in a cutting apparatus different from the inkjet recording apparatus 10 after the image is formed. In the cutting apparatus, the processing mark is read by a sensor or the like, and the continuous paper P is cut according to the processing mark. The cut continuous paper P is, for example, bound.

When image data of the processing mark is recorded in the storage 53, and the acquisition unit 51A acquires information to add the processing mark, the CPU 51 adds the image data of the processing mark to the job information.

In this manner, the image data in the job information includes image data generated by a user, and image data that the control device 50 has in advance. The image data generated by the user may be used as the processing mark.

When the document is read by a reading apparatus (specifically, a scanner), the job execution instruction and the job information are generated, and the job execution instruction and the job information may be acquired by the acquisition unit 51A. In addition, the acquisition unit 51A may acquire the job execution instruction and the job information by inputting the job execution instruction and the job information through the input unit 55.

(Extraction Unit 51B)

The extraction unit 51B extracts an image for position detection from job image data. Specifically, the extraction unit 51B extracts images for detection (example of the image for position detection) to be detected by the detection units 40C, 40M, 40Y from the job image data included in the job information acquired by the acquisition unit 51A.

When the processing mark is included in the job image data, the extraction unit 51B extracts a processing mark as the images for detection that are detected by the detection units 40C, 40M, 40Y. In the present exemplary embodiment, the extraction unit 51B extracts the processing mark with priority over other images (images other than the processing mark) when the processing mark is included in the image data.

When the processing mark is not included in the job image data and a K single image configured with only the K image is included in the image data in the job information, the extraction unit 51B extracts the K single image as an image for detection to be detected by the detection units 40C, 40M, 40Y.

The term single image refers to an image that is configured with an image of one color without forming an image of another color in a predetermined region until the image is detected by the detection unit 40Y on the most downstream. Therefore, the term K single image refers to an image that is configured with only the K image without forming the C image and the M image in a predetermined region until the image is detected by the detection unit 40Y on the most downstream. It should be noted that the Y image is formed after the K single image is detected by the detection unit 40Y on the most downstream, so that an image of two colors consisting of the K image and the Y image in the predetermined region is also included in the K single image. In addition, the processing mark may also be considered as a single image. As an example, the predetermined region is a region of 10 dots of ink (for example, about 0.4 mm in length) in each of the feeding direction and the paper width direction. The predetermined region is not limited to the above region and may be any region of a plurality of dots or more of ink. The predetermined region is set according to detection ability of the detection units 40C, 40M, 40Y.

When the K single image is not included in the job image data, the extraction unit 51B extracts a K image (hereinafter, referred to as a "K detection image") as an image for detection to be detected by the detection unit 40C. The K detection image is an image with which an image of another color (specifically, at least one of the C image and the M image) is superimposed in a predetermined region until the image is detected by the detection unit 40Y on the most downstream. It should be noted that the K detection image is in a state of being present alone at the time of being detected by the detection unit 40C since the time is before the image of another color is formed. The K detection image is an example of a first image.

When the K single image is not included in the job image data and a C single image configured with only the C image is included in the job image data, the extraction unit 51B extracts the C single image as an image for detection to be detected by the detection units 40M, 40Y. When the C single image is not included in the job image data, the extraction unit 51B extracts a C image (hereinafter, referred to as a "C detection image") as an image for detection to be detected by the detection unit 40M. The C detection image is an image with which an image of another color (specifically, at least one of the K image and the M image) is superimposed in a predetermined region until the image is detected by the detection unit 40Y on the most downstream. It should be noted that the C detection image is in a state of being superimposed with the K image or a state of being present alone when detected by the detection unit 40M. The C detection image is an example of a second image.

When the C single image is not included in the job image data and a M single image configured with only the M image is included in the job image data, the extraction unit 51B extracts the M single image as an image for detection to be detected by the detection unit 40Y. When the M single image is not included in the job image data, the extraction unit 51B extracts an M image (hereinafter, referred to as an "M detection image") as an image for detection to be detected by the detection unit 40Y. The M detection image is an image with which an image of another color (specifically, at least one of the K image and the C image) is superimposed in a predetermined region until the image is detected by the detection unit 40Y. It should be noted that the M image is in a state of being superimposed with at least one of the K image and the C image when detected by the detection unit 40Y. Hereinafter, an image extracted as an image for detection by the extraction unit 51B may be called an extracted image.

(Determining Unit 51C)

The determining unit 51C determines a correction amount of an ejection position (an example of an image forming position) of each of the ejection heads 32C, 32M, 32Y based on a position of an extracted image detected by each of the detection units 40C, 40M, 40Y, and a position of the extracted image in the job image data. Specific determining processing will be described below.

(Control Unit 51D)

The control unit 51D has a function of controlling driving of each of the ejection heads 32K to 32Y. Specifically, the control unit 51D controls the driving of the ejection head 32K and executes processing of forming the K image based on the job image data.

The control unit 51D controls the driving of each of the ejection heads 32C, 32M, 32Y based on the correction amount of the ejection position of each of the ejection heads 32C, 32M, 32Y, which is determined by the determining unit 51C, and executes processing of forming each of the C image, the M image, and the Y image based on the job image data. That is, the control unit 51D corrects the respective ejection positions of the ejection heads 32C, 32M, 32Y based on the correction amount of the ejection position of each of the ejection heads 32C, 32M, 32Y, which is determined by the determining unit 51C. Specific image formation processing will be described below. The control unit 51D is an example of a correction unit.

(Reception Unit 51E)

The reception unit 51E has a function of accepting an instruction to designate an image for detection. For example, the reception unit 51E receives an instruction for designating, by a user, an image for detection to be detected by each of the detection units 40C, 40M, 40Y from the external device through the communication interface 54 to accept the instruction. When the reception unit 51E accepts the instruction, extraction processing performed by the extraction unit 51B is not executed.

(Control Processing in Present Exemplary Embodiment)

Figure 4:
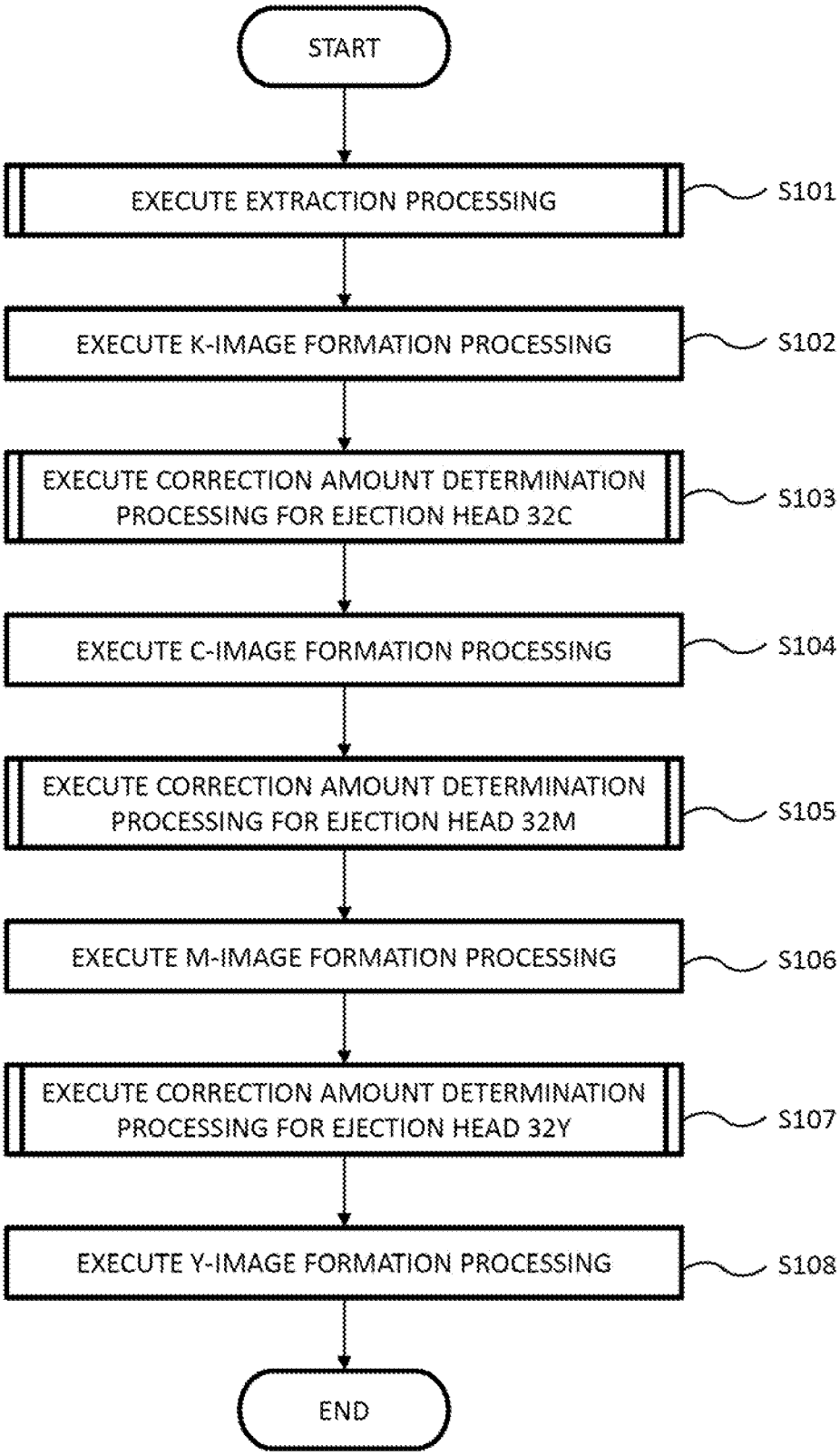
FIG. 4 is a flowchart showing a flow of control processing executed by the control device according to the first exemplary embodiment.

Next, an example of the control processing in the present exemplary embodiment will be described. FIG. 4 is a flowchart showing a flow of control processing executed by the control device 50.

When the job execution instruction and the job information are acquired, the CPU 51 reads the control program from the storage 53 and starts execution of the present control processing.

As shown in FIG. 4, when the present control processing is started, the CPU 51 first executes extraction processing for extracting an image for detection to be detected by the detection units 40C, 40M, 40Y from image data of job information (step S101). Next, the CPU 51 executes K-image formation processing for forming a K image based on the job image data (step S102).

Next, the CPU 51 executes correction amount determining processing for detecting a correction amount of an ejection position of the ejection head 32C (step S103). Next, the CPU 51 corrects the ejection position of the ejection head 32C based on the correction amount determined by the correction amount determining processing for the ejection head 32C, and executes C-image formation processing for forming a C image based on the job image data (step S104).

Next, the CPU 51 executes correction amount determining processing for detecting a correction amount of an ejection position of the ejection head 32M (step S105). Next, the CPU 51 corrects the ejection position of the ejection head 32M based on the correction amount determined by the correction amount determining processing in the ejection head 32M, and executes M-image formation processing for forming an M image based on the job image data (step S106).

Next, the CPU 51 executes correction amount determining processing for detecting a correction amount of an ejection position of the ejection head 32Y (step S107). Next, the CPU 51 corrects the ejection position of the ejection head 32Y based on the correction amount determined by the correction amount determining processing in the ejection head 32Y, and executes Y-image formation processing for forming a Y image based on the job image data (step S108).

The extraction processing (step S101) may be executed before the execution of the correction amount determining processing for the ejection head 32C (step S103), or may be executed after the execution of the K-image formation processing (step S102). Next, specific contents of each processing will be described.

(Extraction Processing)

Figure 5:
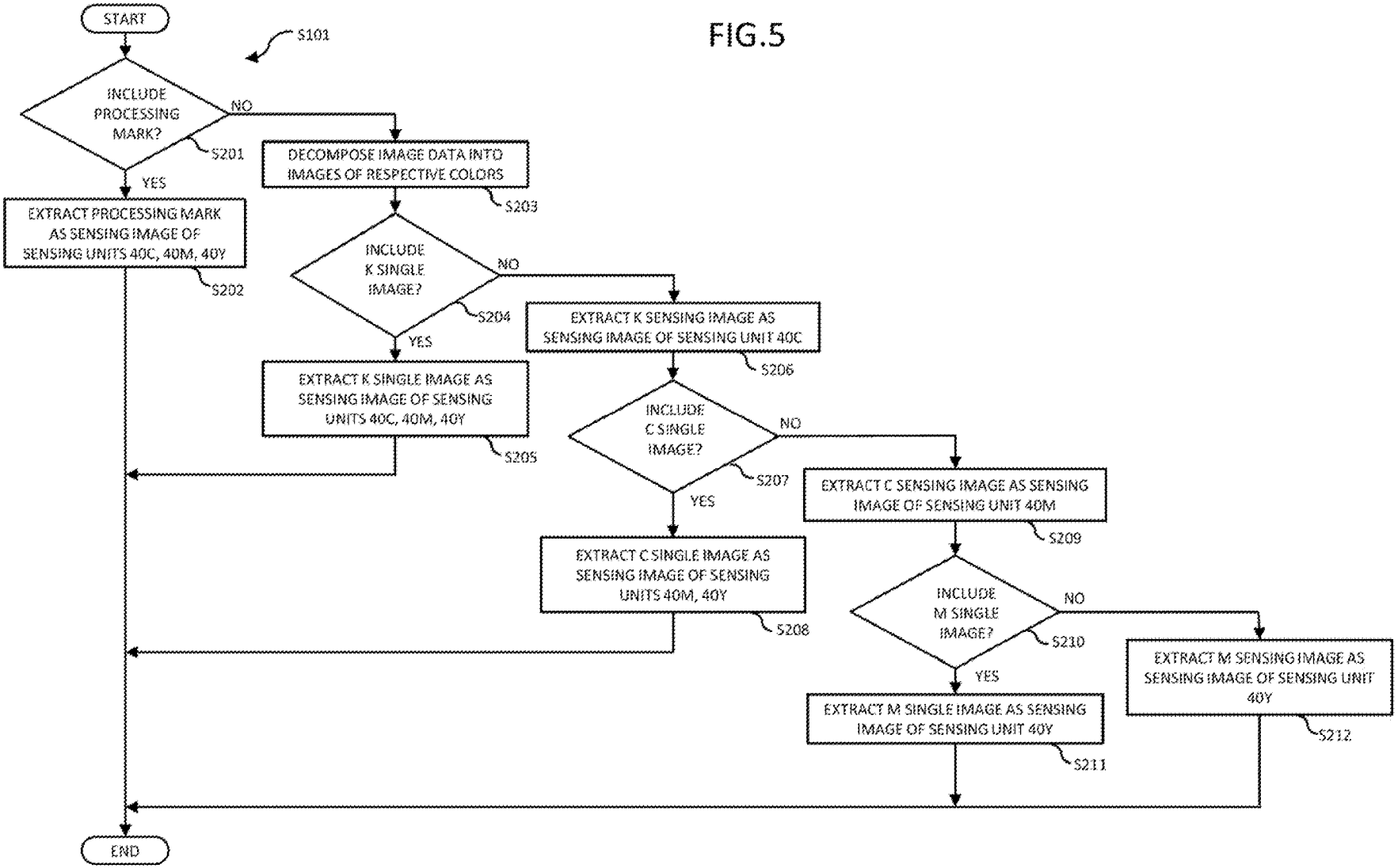
FIG. 5 is a flowchart showing a flow of extraction processing (step S101 in FIG. 4) executed by the control device according to the first exemplary embodiment.

FIG. 5 is a flowchart showing a flow of the extraction processing (step S101 in FIG. 4) executed by the control device 50.

As shown in FIG. 5, when the execution of the extraction processing is started, the CPU 51 determines whether a processing mark is included in the job image data (step S201).

Figure 6:
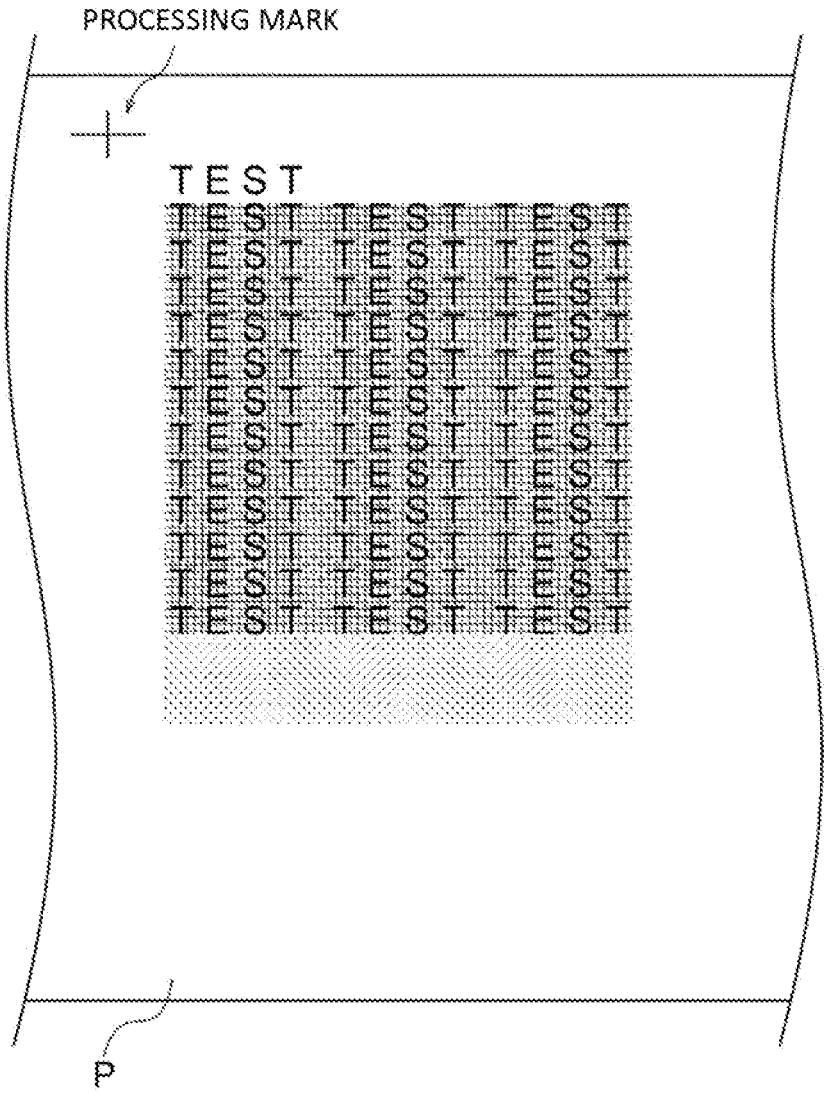
FIG. 6 is a diagram showing a state in which an image of image data including a processing mark according to the first exemplary embodiment is visualized on a continuous paper.

When the processing mark is included in the job image data as shown in FIG. 6 (step S201: YES), the CPU 51 extracts the processing mark as an image for detection to be detected by the detection units 40C, 40M, 40Y (step S202), and the extraction processing is ended. FIGS. 7 to 10 described below, which include FIG. 6, show a state in which image data of job information is visualized on the continuous paper P.

Figure 7A:
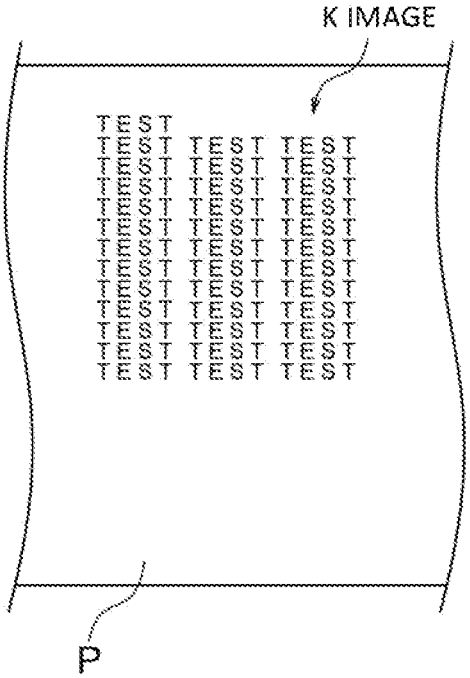
FIG. 7A is a diagram showing K image decomposed from image data according to the first exemplary embodiment.
Figure 7B:
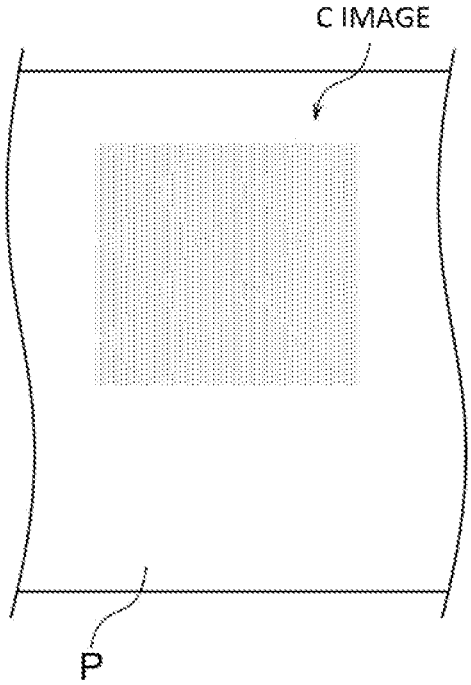
FIG. 7B is a diagram showing C image decomposed from image data according to the first exemplary embodiment.
Figure 7C:
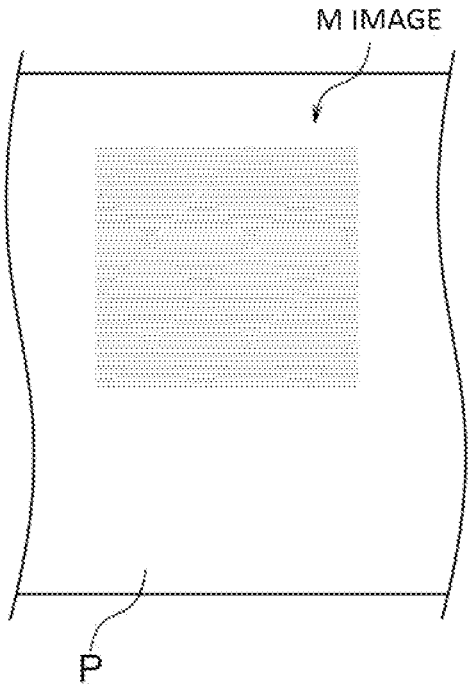
FIG. 7C is a diagram showing M image decomposed from image data according to the first exemplary embodiment.
Figure 7D:
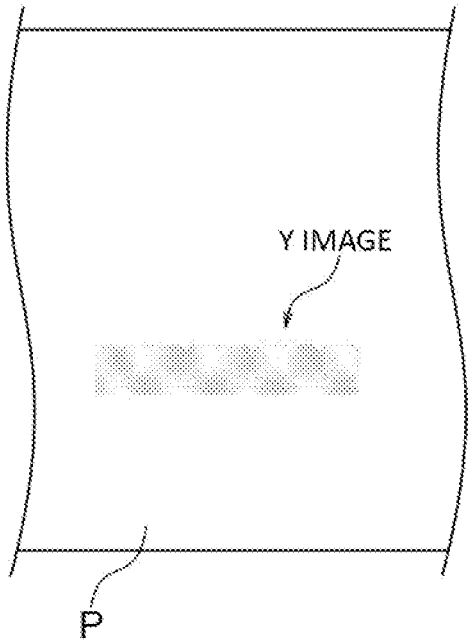
FIG. 7D is a diagram showing Y image decomposed from image data according to the first exemplary embodiment.

When the processing mark is not included in the job image data (step S201: NO), the CPU 51 decomposes an image of the image data into images of respective colors as shown in FIGS. 7A to 7D (step S203). In FIG. 7A, the K image is configured with characters. In FIG. 7B, the C image is indicated by vertical lines. In FIG. 7C, the M image is indicated by horizontal lines. In FIG. 7D, the Y image is indicated by dots.

Figure 8:
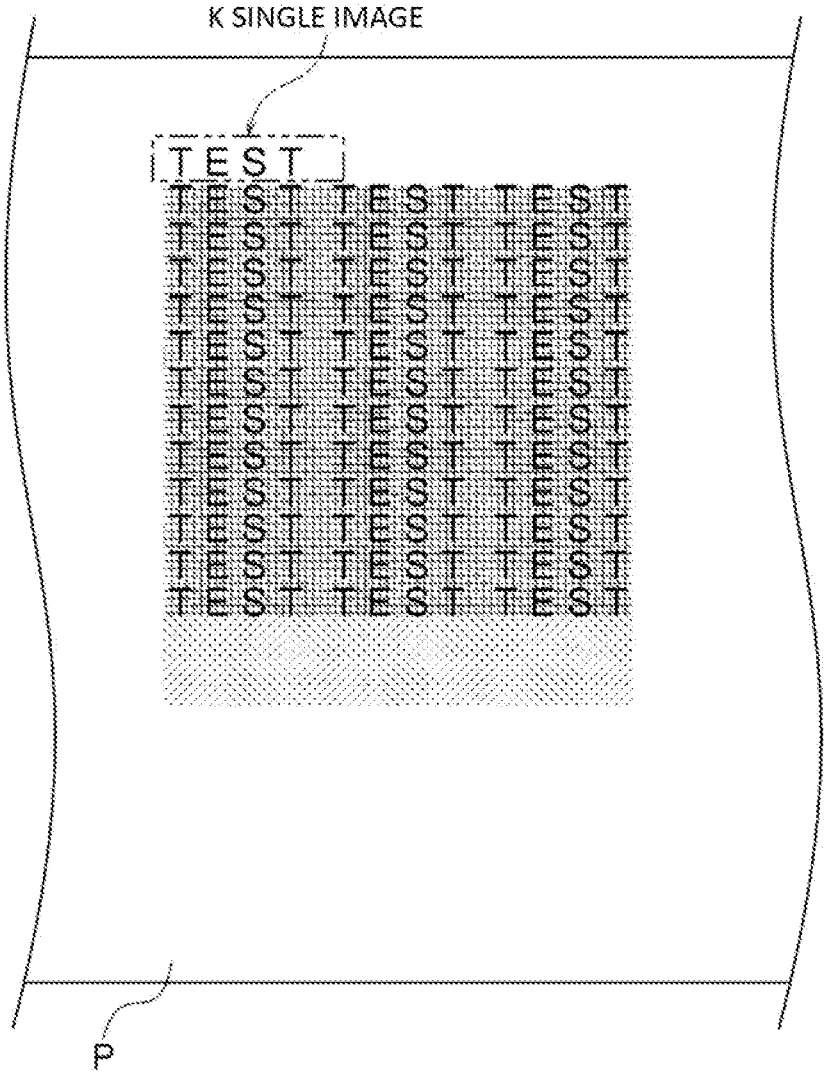
FIG. 8 is a diagram showing a state in which an image of image data including a K single image according to the first exemplary embodiment is visualized on a continuous paper.

Next, the CPU 51 determines whether a K single image configured with only a K image is included in the job image data (step S204). When the K single image is included in the job image data as shown in FIG. 8 (step S204: YES), the CPU 51 extracts the K single image as an image for detection to be detected by the detection units 40C, 40M, 40Y (step S205), and the extraction processing is ended. In FIG. 8, the K single image is an image surrounded by a two-dot chain line.

Figure 9:
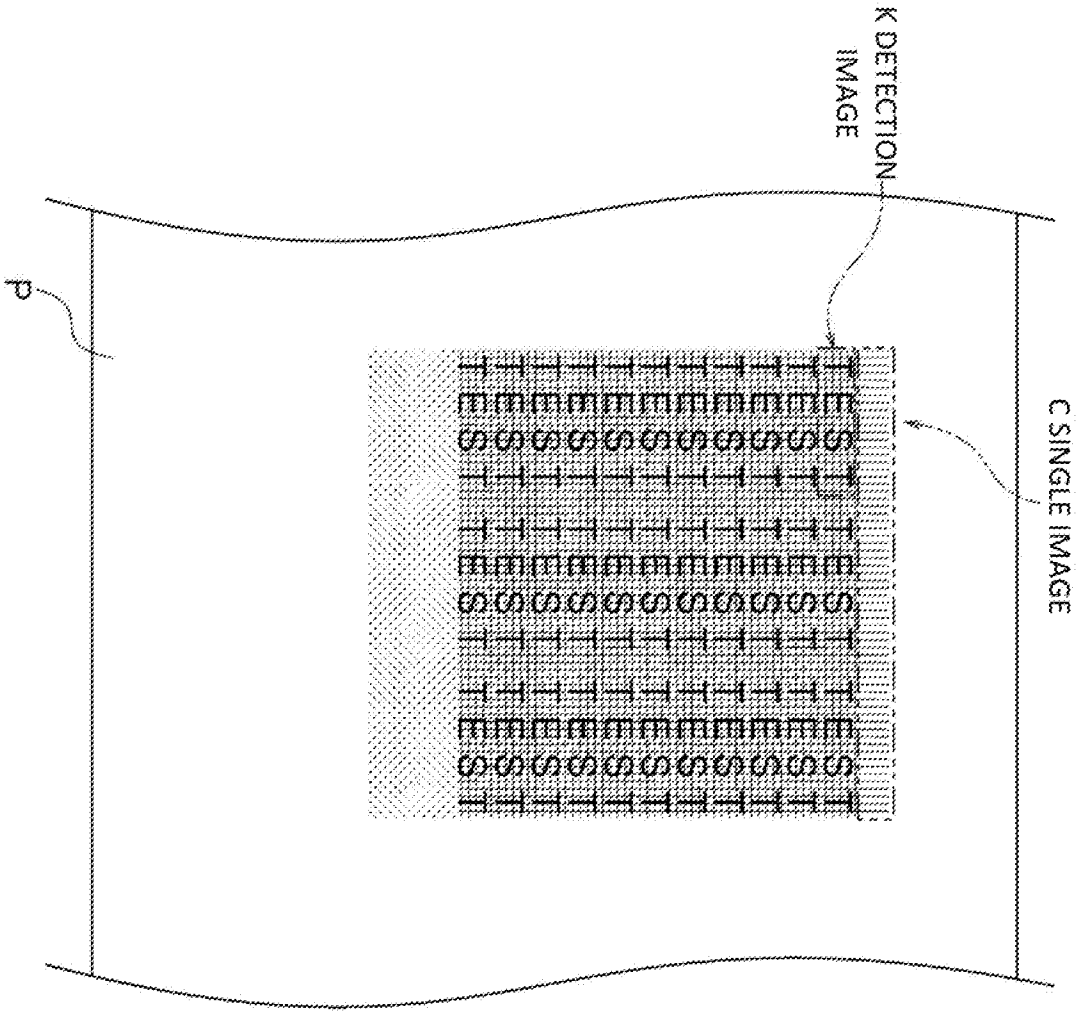
FIG. 9 is a diagram showing a state in which an image of image data including a C single image according to the first exemplary embodiment is visualized on a continuous paper.

When the K single image is not included in the job image data as shown in FIG. 9 (step S204: NO), the CPU 51 extracts a K detection image as an image for detection to be detected by the detection unit 40C (step S206). In FIG. 9, an image surrounded by a one-dot chain line may be used as the K detection image.

Next, the CPU 51 determines whether a C single image configured with only a C image is included in the job image data (step S207). When the C single image is included in the job image data as shown in FIG. 9 (step S207: YES), the CPU 51 extracts the C single image as an image for detection to be detected by the detection units 40M, 40Y (step S208), and the extraction processing is ended. In FIG. 9, the C single image is an image surrounded by a two-dot chain line.

Figure 10:
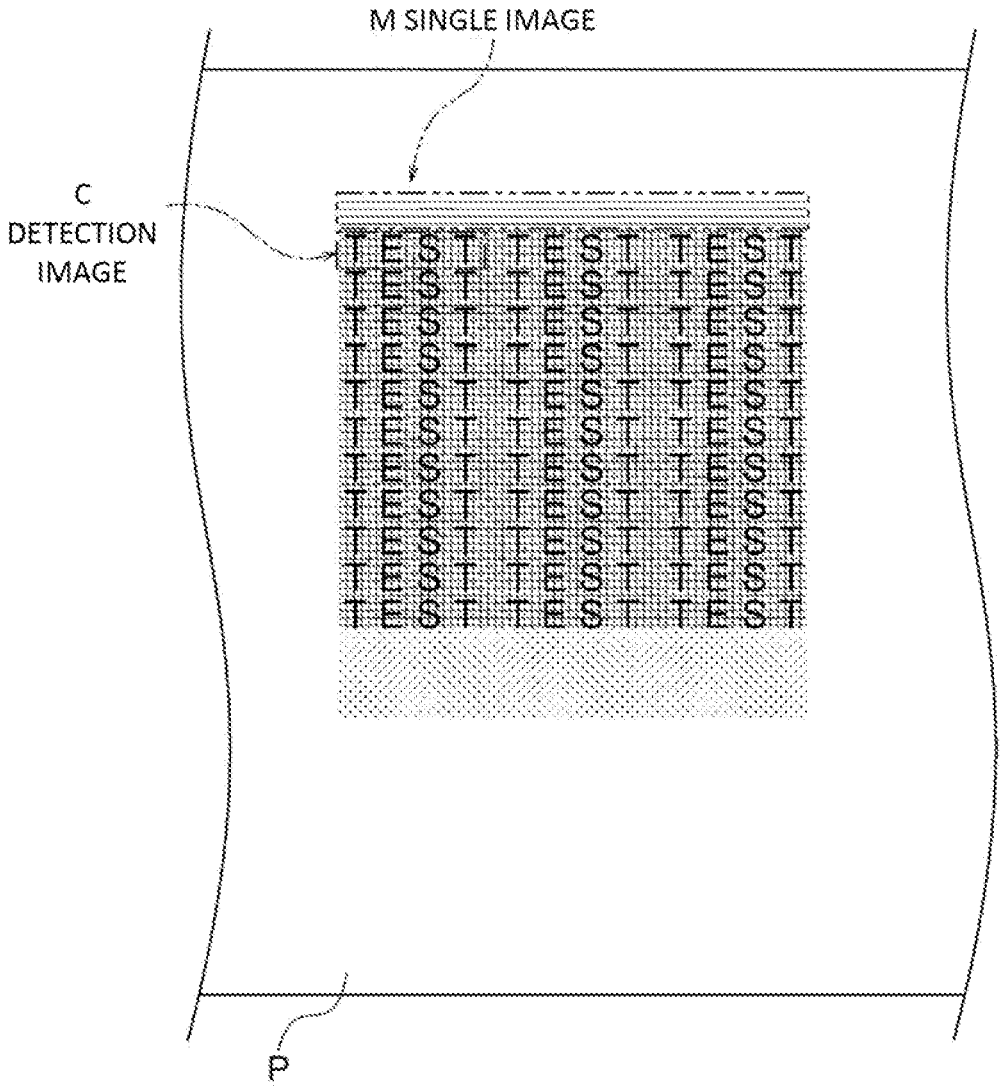
FIG. 10 is a diagram showing a state in which an image of image data including an M single image according to the first exemplary embodiment is visualized on a continuous paper.

When the C single image is not included in the job image data as shown in FIG. 10 (step S207: NO), the CPU 51 extracts a C detection image as an image for detection to be detected by the detection unit 40M (step S209). In FIG. 10, an image surrounded by a one-dot chain line may be used as the C detection image. In FIG. 10, the image surrounded by the one-dot chain line may be used as the K detection image.

Next, the CPU 51 determines whether a M single image configured with only an M image is included in the job image data (step S210). When the M single image is included in the job image data as shown in FIG. 10 (step S210: YES), the CPU 51 extracts the M single image as an image for detection to be detected by the detection unit 40Y (step S211), and the extraction processing is ended. In FIG. 10, the M single image is an image surrounded by a two-dot chain line.

When the M single image is not included in the job image data (step S210: NO), the CPU 51 extracts the M detection image as an image for detection to be detected by the detection unit 40Y (step S212), and the extraction processing is ended.

As described above in the present exemplary embodiment, the CPU 51 determines whether the processing mark is included in the job image data (step S201) before determining whether another image (for example, the K single image, the C single image, and the M single image) is included in the job image data (steps S204, S207, S210 described later). When the processing mark is included in the job image data (step S201: YES), the CPU 51 extracts the processing mark as the images for detection that are detected by the detection units 40C, 40M, 40Y (step S202). That is, when the processing mark is included in the job image data, the CPU 51 extracts the processing mark with priority over another image (for example, the K single image).

(K-Image Formation Processing)

The CPU 51 controls ejection of the ejection head 32K based on the K image in the job image data. As a result, the ejection head 32K ejects black (K) ink droplets onto the continuous paper P to form the K image on the continuous paper P. The K image includes an extracted image extracted by the extraction processing. In other words, the ejection head 32K forms the extracted image extracted by the extraction processing on the continuous paper P. The K image including the extracted image is detected by the detection unit 40C. The extracted image formed by the ejection head 32K is any one of the processing mark (see step S202), the K single image (see step S205), and the K detection image (see step S206).

(Correction Amount Determining Processing for Ejection Head 32C)

The CPU 51 determines a correction amount of an ejection position of the ejection head 32C based on a position of the extracted image detected by the detection unit 40C and a position of the extracted image in the job image data. Specifically, as an example, the CPU 51 determines a correction amount of the ejection position of the ejection head 32C in the feeding direction as follows.

Figure 11:
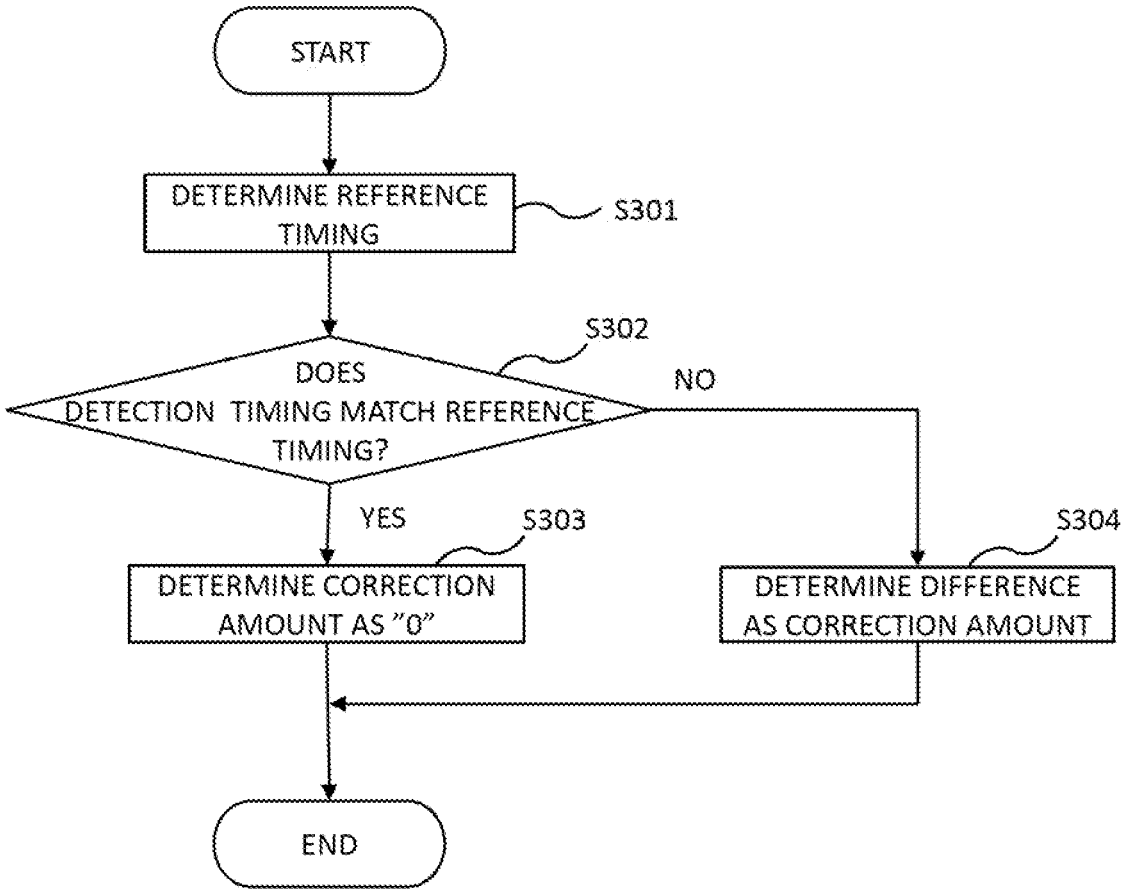
FIG. 11 is a flowchart showing a flow of an example of correction amount determining processing executed by the control device according to the first exemplary embodiment.

As shown in FIG. 11, the CPU 51 first determines a reference timing from the position of the extracted image in the image data (step S301). The reference timing is a timing serving as a reference of a timing at which the detection unit 40C detects the extracted image. That is, when the detection unit 40C detects the extracted image at the reference timing, the correction of the ejection position of the ejection head 32C in the feeding direction is not required (that is, the correction amount is 0). In other words, the reference timing also refers to a timing at which the detection unit 40C detects the extracted image when no fluctuation in the feeding direction occurs on the continuous paper P.

The fluctuation of the continuous paper P in the feeding direction refers to a state in which the continuous paper P is conveyed early or late, and a state in which a timing at which the K image reaches the ejection position of the ejection head 32C is early or late. The fluctuation of the continuous paper P in the feeding direction occurs due to, for example, elongation of the continuous paper P and fluctuation in a tension force of the continuous paper P. The elongation of the continuous paper P occurs since the continuous paper P contains ink and swells, for example.

Next, the CPU 51 determines whether a detection timing at which the detection unit 40C actually detects the extracted image matches the reference timing (step S302). When the detection timing matches the reference timing (step S302:

YES), the CPU 51 determines the correction amount as 0 (step S303). That is, the CPU 51 determines that the correction is not required.

When the detection timing does not match the reference timing (step S302: NO), the CPU 51 determines a difference between the detection timing and the reference timing as a correction amount (step S304). Specifically, for example, when the detection timing is later than the reference timing, the delay amount is determined as the correction amount. For example, when the detection timing is earlier than the reference timing, the earlier amount is determined as the correction amount.

In this manner, the CPU 51 determines a correction amount of an ejection timing of the ejection head 32C based on the detection timing at which the detection unit 40C actually detects the extracted image and the reference timing.

As an example, the CPU 51 determines a correction amount in the paper width direction as follows.

First, the CPU 51 determines a reference position in the paper width direction from the position of the extracted image in the image data (step S401). The reference position is a position serving as a reference in the paper width direction, where the detection unit 40C detects the extracted image. That is, when the detection unit 40C detects the extracted image at the reference position, the correction of the ejection position of the ejection head 32C in the paper width direction is not required (that is, the correction amount is 0). In other words, the reference position also refers to a detection position where the detection unit 40C detects the extracted image when a fluctuation in the paper width direction does not occur on the continuous paper P.

The fluctuation of the continuous paper P in the paper width direction refers to a state in which the continuous paper P is shifted to one of the paper width directions. The fluctuation of the continuous paper P in the paper width direction occurs due to, for example, meandering of the continuous paper P.

Next, the CPU 51 determines whether a detection position where the detection unit 40C actually detects the extracted image matches the reference position (step S402). When the detection position matches the reference position (step S402: YES), the CPU 51 determines the correction amount as 0 (step S403). That is, the CPU 51 determines that the correction is not required.

When the detection position does not match the reference position (step S402: NO), the CPU 51 determines a difference between the detection position and the reference position as a correction amount (step S404). Specifically, for example, when the detection position is shifted to one of the paper width directions relative to the reference position, the shift amount is determined as the correction amount.

(C-Image Formation Processing)

The CPU 51 controls the driving of the ejection head 32C based on the correction amount of the ejection position of the ejection head 32C determined by the correction amount determining processing, and executes processing for forming a C image based on the job image data.

Specifically, the CPU 51 controls the ejection timing of the ejection head 32C based on the correction amount of the ejection timing of the ejection head 32C determined by the correction amount determining processing. On the basis of the correction amount of the ejection position of the ejection head 32C determined by the correction amount determining processing, the CPU 51 changes a nozzle, which ejects ink droplets, to shift the ejection position of the ejection head 32C in the paper width direction. As a result, the ejection head 32C ejects cyan (C) ink droplets onto the continuous paper P to form the C image on the continuous paper P. In this manner, the CPU 51 corrects the ejection position of the ejection head 32C based on the correction amount of the ejection position of the ejection head 32C determined by the correction amount determining processing.

It should be noted that the ejection position of the ejection head 32C may be shifted in the paper width direction by moving the ejection head 32C itself in the paper width direction.

When the C single image (see step S208) or the C detection image (see step S209) is extracted in the extraction processing, the C image formed on the continuous paper P includes the C single image or the C detection image as an extracted image. That is, the ejection head 32C forms the extracted image extracted by the extraction processing on the continuous paper P in this case. The C image including the extracted image is detected by the detection unit 40C.

In the extraction processing, when the processing mark (see step S202) or the K single image (see step S205) is extracted as an image for detection, the C single image (see step S208) and the C detection image (see step S209) are not extracted as an image for detection. In this case, the processing mark (see step S202) or the K single image (see step S205) is determined by the detection unit 40M.

In the present exemplary embodiment, the image formation processing based on the correction amount is executed on a page of the continuous paper P on which an image for detection is formed. The image formation processing based on the correction amount may be executed for a next page or subsequent pages of the page of the continuous paper P on which the detection image is formed.

(Correction Amount Determining Processing for Ejection Head 32M)

The CPU 51 determines a correction amount of an ejection position of the ejection head 32M based on a position of the extracted image detected by the detection unit 40M and a position of the extracted image in the job image data. Specifically, the CPU 51 determines a correction amount of the ejection position of the ejection head 32M in the feeding direction in the same manner as the case of the correction amount determining processing for the ejection head 32C described above (see FIG. 11).

Figure 12:
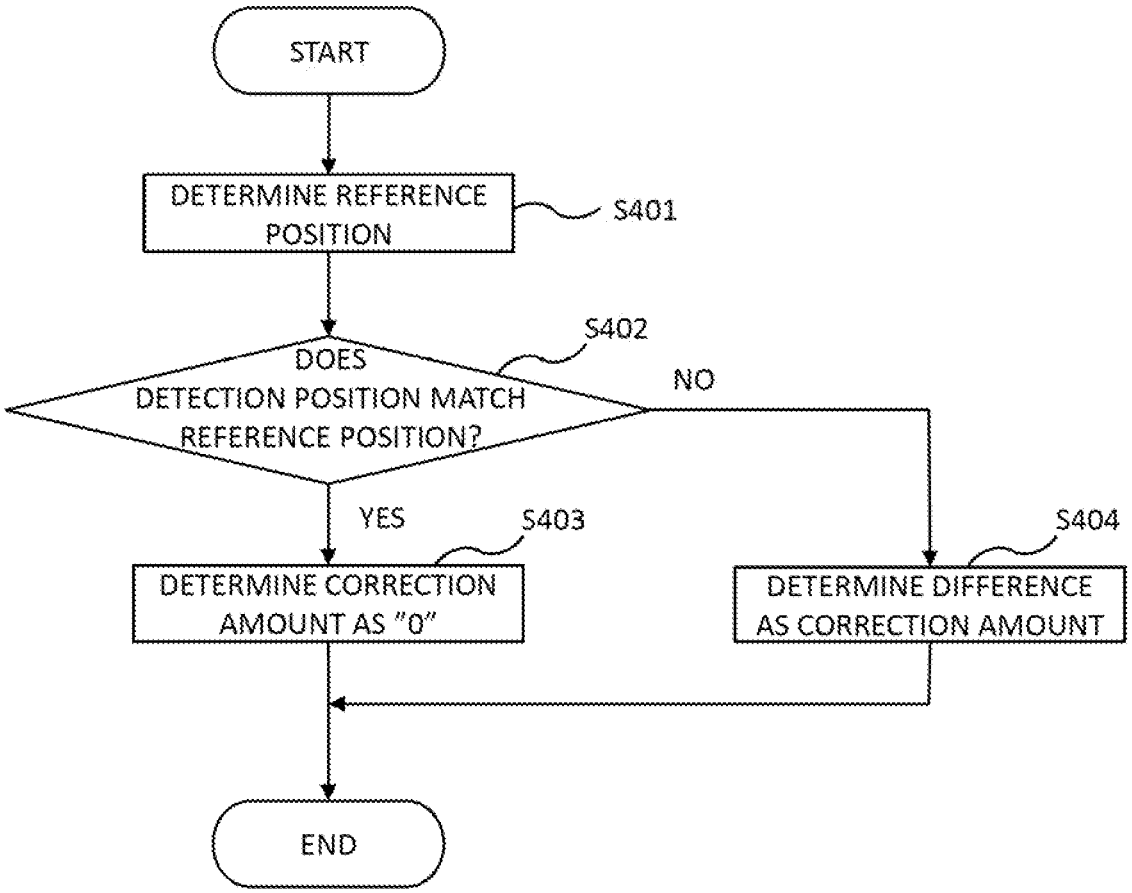
FIG. 12 is a flowchart showing a flow of an example of correction amount determining processing executed by the control device according to the first exemplary embodiment.

The CPU 51 determines a correction amount of the ejection position of the ejection head 32M in the paper width direction in the same manner as the case of the correction amount determining processing for the ejection head 32C described above (see FIG. 12).

(M-Image Formation Processing)

The CPU 51 controls the driving of the ejection head 32M based on the correction amount of the ejection position of the ejection head 32M determined by the correction amount determining processing, and executes processing for forming an M image based on the job image data.

Specifically, the CPU 51 controls an ejection timing of the ejection head 32M based on the correction amount of the ejection timing of the ejection head 32M determined by the correction amount determining processing. On the basis of the correction amount of the ejection position of the ejection head 32M determined by the correction amount determining processing, the CPU 51 changes a nozzle, which ejects ink droplets, to shift the ejection position of the ejection head 32M in the paper width direction. As a result, the ejection head 32M ejects magenta (M) ink droplets onto the continuous paper P to form an M image on the continuous paper P. In this manner, the CPU 51 corrects the ejection position of the ejection head 32M based on the correction amount of the ejection position of the ejection head 32M determined by the correction amount determining processing.

It should be noted that the ejection position of the ejection head 32M may be shifted in the paper width direction by moving the ejection head 32M itself in the paper width direction.

When the M single image (see step S211) or the M detection image (see step S212) is extracted in the extraction processing, the M image formed on the continuous paper P includes the M single image or the M detection image as an extracted image. That is, the ejection head 32M forms the extracted image extracted by the extraction processing on the continuous paper P in this case. The M image including the extracted image is detected by the detection unit 40Y.

In the extraction processing, when any one of the processing mark (see step S202), the K single image (see step S205), and the C single image (see step S208) is extracted as an image for detection, the M single image (see step S211) and the M detection image (see step S212) are not extracted as a detection image. In this case, anyone of the processing mark (see step S202), the K single image (see step S205), and the C single image (see step S208) is detected by the detection unit 40Y.

In the present exemplary embodiment, the image formation processing based on the correction amount is executed on a page of the continuous paper P on which an image for detection is formed. The image formation processing based on the correction amount may be executed for a next page or subsequent pages of the page of the continuous paper P on which the detection image is formed.

(Correction Amount Determining Processing for Ejection Head 32Y)

The CPU 51 determines a correction amount of an ejection position of the ejection head 32Y based on a position of the extracted image detected by the detection unit 40Y and a position of the extracted image in the job image data. Specifically, the CPU 51 determines a correction amount of the ejection position of the ejection head 32Y in the feeding direction in the same manner as the case of the correction amount determining processing for the ejection head 32C described above (see FIG. 11).

The CPU 51 determines a correction amount of the ejection position of the ejection head 32Y in the paper width direction in the same manner as the case of the correction amount determining processing for the ejection head 32C described above (see FIG. 12).

(Y-Image Formation Processing)

The CPU 51 controls the driving of the ejection head 32Y based on the correction amount of the ejection position of the ejection head 32Y determined by the correction amount determining processing, and executes processing for forming a Y image based on the job image data.

Specifically, the CPU 51 controls an ejection timing of the ejection head 32Y based on the correction amount of the ejection timing of the ejection head 32Y determined by the correction amount determining processing. On the basis of the correction amount of the ejection position of the ejection head 32Y determined by the correction amount determining processing, the CPU 51 changes a nozzle, which ejects ink droplets, to shift the ejection position of the ejection head 32Y in the paper width direction. As a result, the ejection head 32Y ejects yellow (Y) ink droplets onto the continuous paper P to form the Y image on the continuous paper P. In this manner, the CPU 51 corrects the ejection position of the ejection head 32Y based on the correction amount of the ejection position of the ejection head 32Y determined by the correction amount determining processing.

In the present exemplary embodiment, the image formation processing based on the correction amount is executed on a page of the continuous paper P on which an image for detection is formed. The image formation processing based on the correction amount may be executed for a next page or subsequent pages of the page of the continuous paper P on which the detection image is formed.

It should be noted that the ejection position of the ejection head 32Y may be shifted in the paper width direction by moving the ejection head 32Y itself in the paper width direction.

(Effects According to Present Exemplary Embodiment)

Next, effects according to the present exemplary embodiment will be described.

According to the present exemplary embodiment, an image for detection is extracted from the job image data, and a detection result of the extracted image is used to detect a correction amount of an ejection position of each of the ejection heads 32C, 32M, 32Y. In other words, in the present exemplary embodiment, an image, which is formed in an image region R of the continuous paper P based on the job image data by an instruction of the job execution, is used to detect the correction amount of the ejection position of each of the ejection heads 32C, 32M, 32Y.

Figure 13:
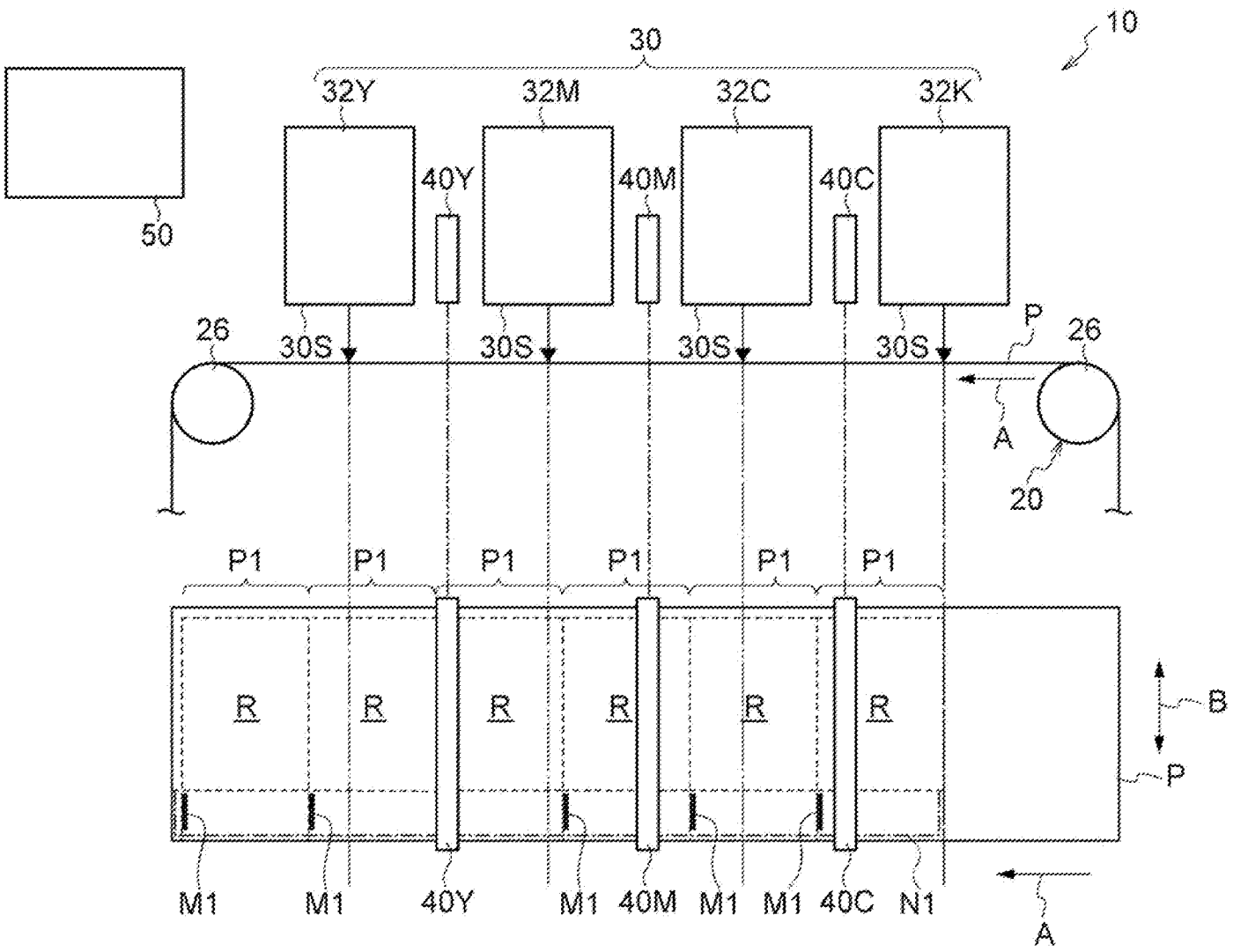
FIG. 13 is a schematic diagram showing a configuration to form a mark dedicated to detection on a continuous paper.

Here, in a configuration (hereinafter, referred to as a first configuration) in which a mark dedicated to detection is formed on the continuous paper P, a detection result obtained by detecting the mark dedicated to detection formed on the continuous paper P is used to detect the correction amount of the ejection position of each of the ejection heads 32C, 32M, 32Y. As shown in FIG. 13, a region N1 where a mark M1 dedicated to detection is formed, which is different from the image region R is required to be provided in the first configuration, so that the image region R is narrower as the region N1 is provided.

In contrast, in the present exemplary embodiment, the image, which is formed in the image region R of the continuous paper P based on the job image data by the instruction of the job execution, is used to detect the correction amount of the ejection position of each of the ejection heads 32C, 32M, 32Y as described above, the image region R that may be used by a user becomes large.

In the present exemplary embodiment, when the processing mark (see step S202) or the K single image (see step S205), which is formed by the ejection of the ejection head 32K, is selected as a detection image, each of the detection units 40C, 40M, 40Y detects the extracted image. Then, the correction amount of the ejection position of each of the ejection heads 32C, 32M, 32Y is determined based on the position of the extracted image detected by each of the detection units 40C, 40M, 40Y and the position of the extracted image in the job image data (steps S103, S105, S107). Therefore, an image formed by each of the ejection heads 32C, 32M, 32Y is aligned with the image formed by the ejection head 32K.

In the present exemplary embodiment, as shown in FIG. 5, the K single image is extracted as an image for detection to be detected by the detection units 40C, 40M, 40Y (step S205) when the K single image is included in the job image data (step S204: YES). Then, the correction amount of the ejection position of each of the ejection heads 32C, 32M, 32Y is determined based on the position of the extracted image detected by each of the detection units 40C, 40M, 40Y and the position of the extracted image in the job image data (steps S103, S105, S107).

Here, in a configuration (hereinafter, referred to as a second configuration) in which an image, in which the K image formed by the ejection head 32K and the C image formed by the ejection head 32C overlap each other, is extracted as an image for detection, when an ejection position of the ejection head 32K and an ejection position of the ejection head 32C are shifted, an image in which the K image and the C image overlap each other in a shifted-position state is detected. Therefore, a detection error may occur in the correction amount of the ejection position of each of the ejection heads 32M, 32Y.

In contrast, when the K single image is extracted as the images for detection that are detected by the detection units 40C, 40M, 40Y, the image formed by the ejection head 32K alone is used, and therefore, a detection error of the correction amount is prevented as compared with the second configuration.

In the present exemplary embodiment, when the K single image is not included in the job image data (step S204: NO), the K detection image is extracted as an image for detection to be detected by the detection unit 40C (step S206). Then, the correction amount of the ejection position of the ejection head 32C is determined based on the position of the extracted image detected by the detection unit 40C and the position of the extracted image in the job image data (step S103). In addition, the C single image (see step S208) or the C detection image (see step S209) is extracted, and the correction amount of the ejection position of the ejection head 32M is determined based on the position of the extracted image detected by the detection unit 40M and the position of the extracted image in the job image data (step S105).

In this case, the C image formed by the ejection head 32C is aligned with the K image formed by the ejection head 32K, and the M image formed by the ejection head 32M is aligned with the C image formed by the ejection head 32C.

In the present exemplary embodiment, when the processing mark is included in the job image data (step S201: YES), the processing mark is extracted as the images for detection that are detected by the detection units 40C, 40M, 40Y (step S202). The processing mark is a mark used for processing of the continuous paper P and is a predetermined mark. In the present exemplary embodiment, the processing mark is a predetermined mark recorded in the storage 53.

Therefore, the extraction processing of the detection image is simpler as compared with a configuration in which only an image other than the processing mark (for example, an image designated by the user) is extracted as the detection image.

In the present exemplary embodiment, when the processing mark is included in the job image data, the CPU 51 extracts the processing mark with priority over another image (for example, the K single image). Therefore, the extraction processing of the detection image is simpler as compared with a configuration in which another image is extracted with priority.

(Modification of Extraction Processing)

In the present exemplary embodiment, when the K single image is included in the job image data (step S204: YES), the CPU 51 extracts the K single image as the images for detection that are detected by the detection units 40C, 40M, 40Y (step S205), but the present invention is not limited to this example. For example, the CPU 51 may extract the K detection image as an image for detection to be detected by the detection unit 40C (step S206) without executing the determination of whether the K single image is included in the job image data (step S204). That is, the CPU 51 may extract the K detection image as the detection image to be detected by the detection unit 40C regardless of whether the K single image is included in the job image data.

Similarly, when the C single image is included in the job image data (step S207: YES), the CPU 51 extracts the C single image as the images for detection that are detected by the detection units 40M, 40Y (step S208), but the present invention is not limited to this example. For example, the CPU 51 may extract the C detection image as an image for detection to be detected by the detection unit 40M (step S209) without executing the determination of whether the C single image is included in the job image data (step S207). That is, the CPU 51 may extract the C detection image as the detection image to be detected by the detection unit 40M regardless of whether the C single image is included in the job image data.

Similarly, when the M single image is included in the job image data (step S210: YES), the CPU 51 extracts the M single image as the detection image to be detected by the detection unit 40Y (step S211), but the present invention is not limited to this example. For example, the CPU 51 may extract the M detection image as an image for detection to be detected by the detection unit 40Y (step S212) without executing the determination of whether the M single image is included in the job image data (step S210). That is, the CPU 51 may extract the M detection image as the detection image to be detected by the detection unit 40Y regardless of whether the M single image is included in the job image data.

In the present exemplary embodiment, the control device 50 includes the reception unit 51E that receives an instruction designating an image for detection. Therefore, an image for detection may be designated by the user.

In the present exemplary embodiment, the detection units 40C to 40Y each have a length that is equal to or larger than a width of the image region R of the continuous paper P. Therefore, even if the detection image is formed at any position in the width direction of the image region R, the detection image may be detected.

Specifically, the detection units 40C to 40Y each have a length that is equal to or larger than the width of the continuous paper P. Therefore, even if the detection image extends beyond the image region R and is formed on the continuous paper P, the detection image may be detected.

(Modification of Correction Amount Determining Processing for Ejection Heads 32C, 32M, 32Y)

Each of the detection units 40C, 40M, 40Y detects a correction amount of an ejection position of each of the ejection heads 32C, 32M. 32Y based on a position of a detected extracted image and a position of the extracted image in image data of job information, but the present invention is not limited to this example. For example, each of the detection units 40C, 40M, 40Y may detect the correction amount of the ejection position of each of the ejection heads 32C, 32M, 32Y based on a shape of a detected extracted image and a shape of the extracted image in the job image data.

Figure 14:
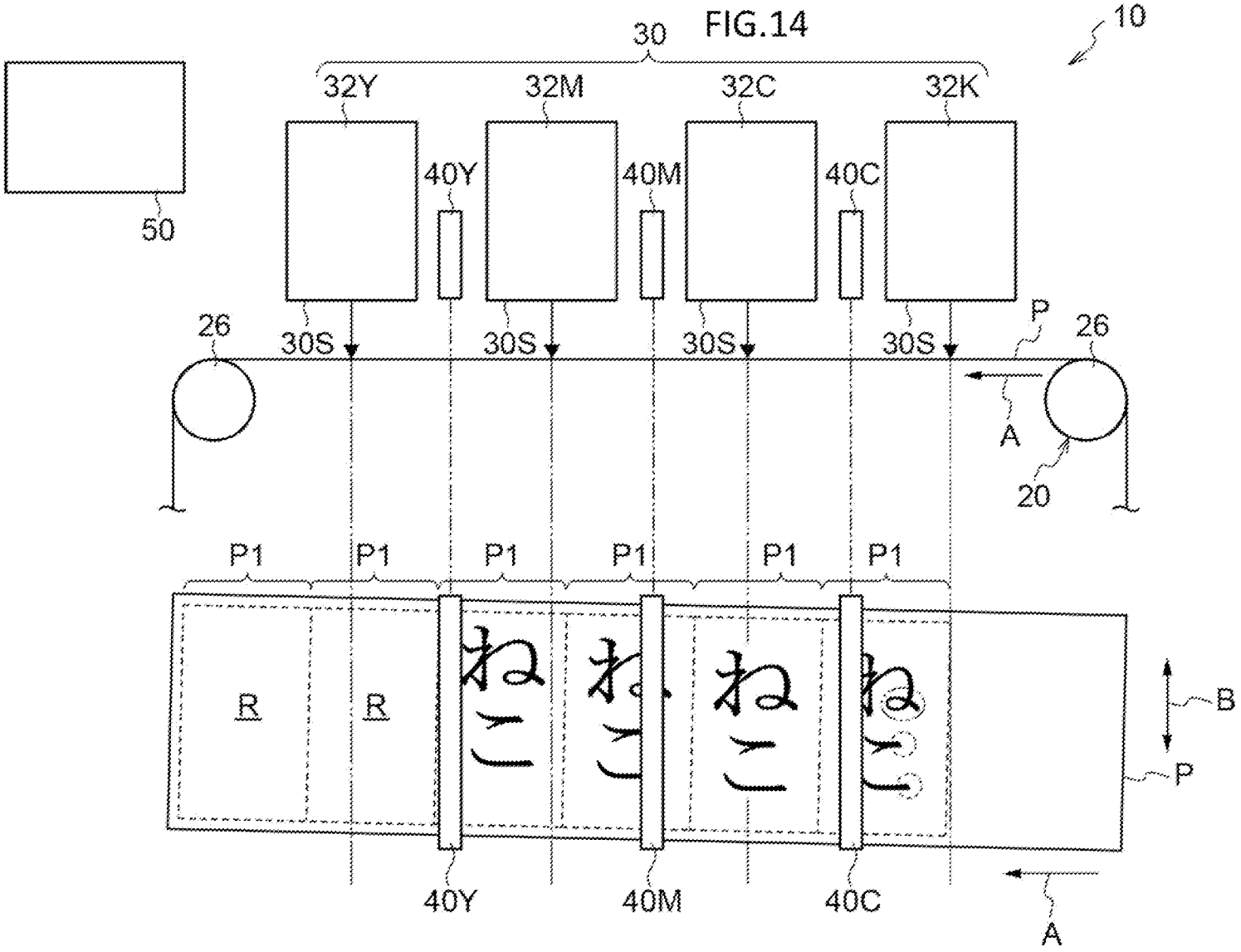
FIG. 14 is a schematic diagram showing a modification in which a feature portion (a part having a feature in a shape) of a K image in image data is extracted.

Specifically, a feature portion (a part having a feature in a shape) of a K image (for example, a K single image) in the job image data is extracted, and the correction amount of the ejection position of each of the ejection heads 32C, 32M, 32Y may be determined based on a shape of the extracted image. Examples of the feature portion include apart formed in a ring shape (for example, a part surrounded by a two-dot chain line in FIG. 14).

For example, as an image for detection, an image of two points apart in the paper width direction (for example, parts surrounded by broken lines in FIG. 14) may be extracted. In this case, each of the detection units 40C, 40M, 40Y may detect a correction amount of skew (tilt) of each of the ejection heads 32C, 32M, 32Y based on a position of the extracted image of the two points detected by each of the detection units 40C, 40M, 40Y and a position of the extracted image of the two points in the job image data.

In this manner, the correction amount of the ejection position of each of the ejection heads 32C, 32M, 32Y may be determined from the extracted image, and various methods including a common method may be used as a method of detecting a correction amount.

Second Exemplary Embodiment

Figure 15:
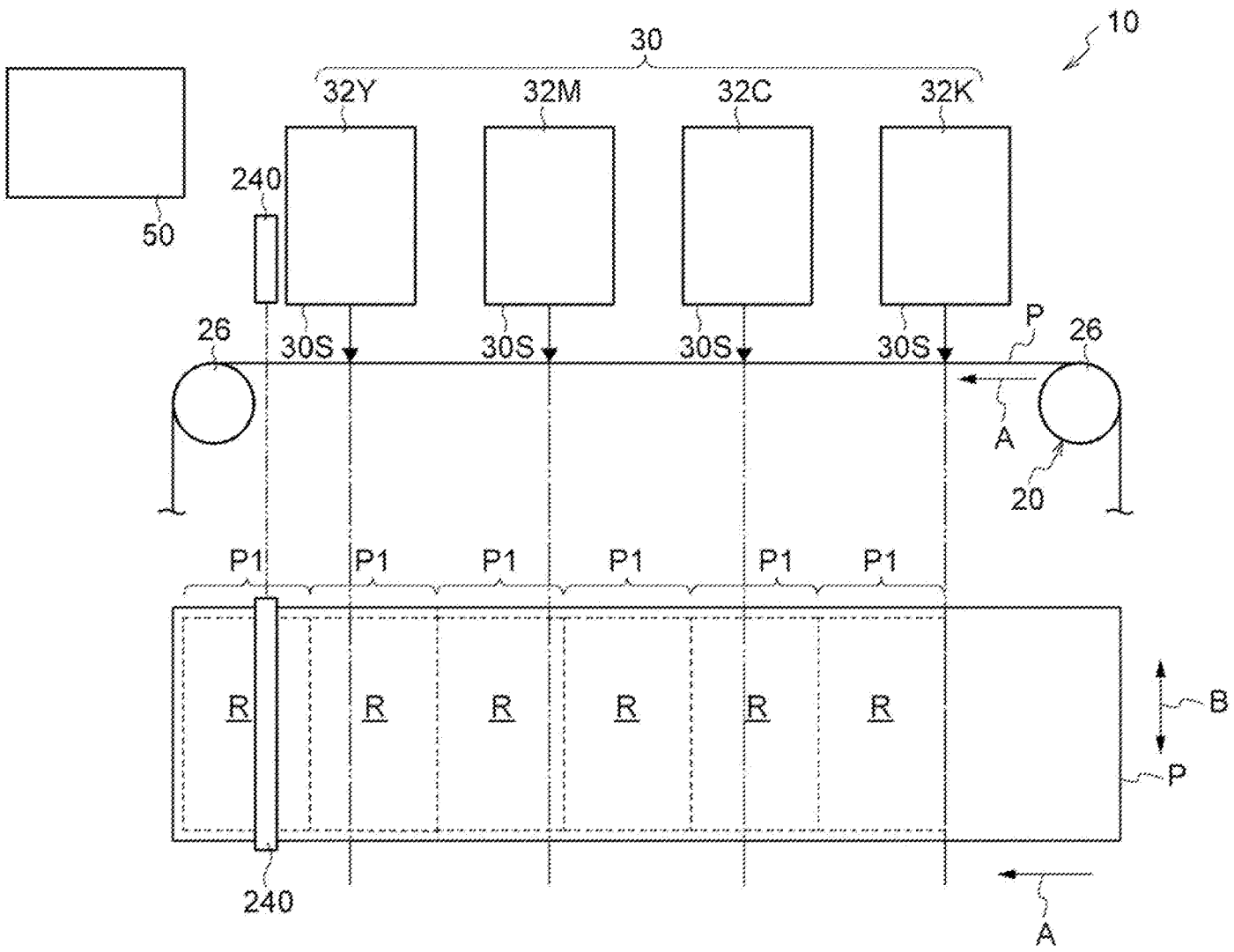
FIG. 15 is a schematic diagram showing a configuration of an inkjet recording apparatus according to a second exemplary embodiment.

Next, an inkjet recording apparatus 200 according to a second exemplary embodiment will be described. FIG. 15 is a schematic diagram showing a configuration of the inkjet recording apparatus 200 according to the second exemplary embodiment. The same parts as those in the first exemplary embodiment are denoted by the same reference numerals, and description thereof is omitted as appropriate.

Each of the detection units 40C, 40M, 40Y is disposed between the corresponding two ejection heads among the ejection heads 32K to 32Y in the first exemplary embodiment, and in the present exemplary embodiment, a single detection unit 240 is disposed on a downstream in a feeding direction relative to the ejection head 32Y disposed on the most downstream in the feeding direction. The detection unit 240 is an example of a detection unit.

In the present exemplary embodiment, the extraction unit 51B extracts each of a K image, a C image, an M image, and a Y image as an image for detection to be detected by the detection unit 240. As the K image, for example, anyone of the processing mark, the K single image, and the K detection image described above is extracted. As each of the C image, the M image, and the Y image, for example, each of a C single image, an M single image, and a Y single image is respectively selected.

The determining unit 51C determines an amount, which is obtained by subtracting "a shift amount between a position of a C image detected by the detection unit 240 and a position of the C image in the job image data in the feeding direction and the paper width direction" from "a shift amount between a position of a K image detected by the detection unit 240 and a position of the K image in the job image data in the feeding direction and the paper width direction", as a correction amount of an ejection position of the ejection head 32C. In other words, the determining unit 51C determines an amount, which is obtained by subtracting "a difference between the position of the K image and the position of the C image on an image detected by the detection unit 240" from "a difference between the position of the K image and the position of the C image on image data", as the correction amount of the ejection position of the ejection head 32C.

Similarly, the determining unit 51C determines an amount, which is obtained by subtracting "a difference between a position of a C image and a position of an M image on an image detected by the detection unit 240" from "a difference between the position of the C image and the position of the M image on image data", as a correction amount of an ejection position of the ejection head 32M.

Similarly, the determining unit 51C determines an amount, which is obtained by subtracting "a difference between a position of an M image and a position of a Y image on an image detected by the detection unit 240" from "a difference between the position of the M image and the position of the Y image on image data", as a correction amount of an ejection position of the ejection head 32M.

The control unit 51D controls the driving of each of the ejection heads 32C, 32M, 32Y based on the correction amount of the ejection position of each of the ejection heads 32C. 32M, 32Y, which is determined by the determining unit 51C, and executes processing of forming each of the C image, the M image, and the Y image based on the job image data. In the present exemplary embodiment, image formation processing based on the correction amount is executed on a next page or subsequent pages of the page on which an image for detection is formed.

The detection unit 240 is disposed on a downstream in a feeding direction relative to the ejection head 32Y disposed on the most downstream in the feeding direction in the present exemplary embodiment, so that a degree of freedom in an arrangement of the detection unit is higher as compared with a configuration in which a detection unit is disposed between each two of the ejection heads 32K to 32Y. In the present exemplary embodiment, the detection unit is configured with the single detection unit 240, so that the number of parts may be reduced, the cost may be reduced, and the configuration may be simplified.

MODIFICATION

In the first and second exemplary embodiments, the inkjet recording apparatuses 10, 200 are used as an example of the image forming apparatus, but the present invention is not limited thereto. For example, a xerography image forming apparatus, which forms a toner image on a continuous paper P through steps of charging, exposure, development, transfer, and fixing, may be used.

The present invention is not limited to the above-described exemplary embodiments, and various modifications, changes, and improvements may be made without departing from the scope of the present invention. For example, the modifications shown above may be combined with each other as appropriate.

In the above exemplary embodiments, the processor means a broadly defined processor, and includes a general-purpose processor (for example, CPU described above) or a dedicated processor (for example, GPU: Graphics Processing Unit, ASIC: Application Specific Integrated Circuit, FPGA: Field Programmable Gate Array, programmable logic device).

The operation of the processor in the above exemplary embodiments may be implemented not only by one processor but also by a plurality of processors existing at physically separated positions. An order of operations of the processor is not limited to only the order described in the exemplary embodiments above, and may be changed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an extraction unit configured to extract an image for position detection from job image data;

a first image forming unit configured to form the image for position detection on a recording medium;

a second image forming unit disposed on a downstream in a feeding direction of the recording medium relative to the first image forming unit;

a first detection unit configured to detect the image for position detection formed by the first image forming unit; and a determining unit configured to determine a correction amount of an image forming position of the second image forming unit based on a position of the image for position detection that is detected by the detection unit and a position of the image for position detection in the image data.

2. The image forming apparatus according to claim 1, further comprising:

a second detection unit that is disposed on a downstream in the feeding direction of the second image forming unit, the second detection unit being configured to detect the image for position detection formed by the first image forming unit; and a third image forming unit disposed on a downstream in the feeding direction of the second detection unit, wherein the first detection unit is disposed on an upstream in the feeding direction relative to the second image forming unit and on a downstream in the feeding direction relative to the first image forming unit, and the determining unit is configured to determine a correction amount of an image forming position of the third image forming unit based on a position of an image for position detection that is detected by the second detection unit and a position of the image for position detection in the job image data.

3. The image forming apparatus according to claim 2, wherein the extraction unit is configured to extract a single image configured with only an image formed by the first image forming unit as the image for position detection.

4. The image forming apparatus according to claim 3, wherein the extraction unit is configured to extract a first image formed by the first image forming unit and a second image formed by the second image forming unit as the image for position detection in a case where the job image data does not include the single image, and the determining unit is configured to determine a correction amount of a formation position of the second image forming unit based on a position of the first image detected by the first detection unit and a position of the first image in the image data, and a correction amount of a formation position of the third image forming unit based on a position of the second image detected by the second detection unit and a position of the second image in the image data.

5. The image forming apparatus according to claim 4, wherein the extraction unit extracts a processing mark as an image for position detection.

6. The image forming apparatus according to claim 5, wherein the extraction unit is configured to extract the processing mark with priority over other images when the processing mark is included in the image data.

7. The image forming apparatus according to claim 1, wherein the extraction unit extracts a processing mark as an image for position detection.

8. The image forming apparatus according to claim 7, wherein the extraction unit is configured to extract the processing mark with priority over other images when the processing mark is included in the image data.

9. The image forming apparatus according to claim 1, wherein the first detection unit is disposed on a downstream in the feeding direction relative to the second image forming unit, the first extraction unit is configured to extract a first image formed by the first image forming unit and a second image formed by the second image forming unit as the images for position detection, and the determining unit is configured to determine a correction amount of a formation position of the second image forming unit based on:

a first difference between a position of the first image detected by the detection unit and a position of the first image in the image data; and a second difference between a position of the second image detected by the detection unit and a position of the second image in the image data.

10. The image forming apparatus according to claim 1, wherein the first detection unit has a length that is equal to or larger than a width of an image region of the recording medium.

11. The image forming apparatus according to claim 10, wherein the first detection unit has a length that is equal to or larger than a width of the recording medium.

12. The image forming apparatus according to claim 1, further comprising a reception unit configured to receive an instruction designating the image for position detection.

13. The image forming apparatus according to claim 1, further comprising a correction unit configured to correct the image forming position based on the correction amount determined by the determining unit.

14. The image forming apparatus according to claim 2, wherein the extraction unit extracts a processing mark as an image for position detection.

15. The image forming apparatus according to claim 14, wherein the extraction unit is configured to extract the processing mark with priority over other images when the processing mark is included in the image data.

16. The image forming apparatus according to claim 2, wherein the first detection unit is disposed on a downstream in the feeding direction relative to the second image forming unit, the first extraction unit is configured to extract a first image formed by the first image forming unit and a second image formed by the second image forming unit as the images for position detection, and the determining unit is configured to determine a correction amount of a formation position of the second image forming unit based on:

a first difference between a position of the first image detected by the detection unit and a position of the first image in the image data; and a second difference between a position of the second image detected by the detection unit and a position of the second image in the image data.

17. The image forming apparatus according to claim 3, wherein the extraction unit extracts a processing mark as an image for position detection.

18. The image forming apparatus according to claim 17, wherein the extraction unit is configured to extract the processing mark with priority over other images when the processing mark is included in the image data.

19. The image forming apparatus according to claim 3, wherein the first detection unit is disposed on a downstream in the feeding direction relative to the second image forming unit, the first extraction unit is configured to extract a first image formed by the first image forming unit and a second image formed by the second image forming unit as the images for position detection, and the determining unit is configured to determine a correction amount of a formation position of the second image forming unit based on:

a first difference between a position of the first image detected by the detection unit and a position of the first image in the image data; and a second difference between a position of the second image detected by the detection unit and a position of the second image in the image data.

20. The image forming apparatus according to claim 4, wherein the first detection unit is disposed on a downstream in the feeding direction relative to the second image forming unit, the first extraction unit is configured to extract a first image formed by the first image forming unit and a second image formed by the second image forming unit as the images for position detection, and the determining unit is configured to determine a correction amount of a formation position of the second image forming unit based on:

a first difference between a position of the first image detected by the detection unit and a position of the first image in the image data; and a second difference between a position of the second image detected by the detection unit and a position of the second image in the image data.

* * * * *